US005401149A

United States Patent [19]

Tsuru et al.

[11] Patent Number: 5,401,149

[45] Date of Patent: Mar. 28, 1995

[54] PACKAGE-TYPE SCREW COMPRESSOR HAVING COATED ROTORS

[75] Inventors: Seiji Tsuru; Shinichi Hirose, both of Ibaraki; Junji Okita, Ishioka; Tadashi Kaneki; Katsuaki Kikuchi, both of Tsuchiura, all of Japan

[73] Assignee: Hitachi, Ltd., Japan

[21] Appl. No.: 116,755

[22] Filed: Sep. 7, 1993

[30] Foreign Application Priority Data

Sep. 11, 1992 [JP] Japan ..... 4-243033
Sep. 11, 1992 [JP] Japan ..... 4-243034

[51] Int. Cl.[6] ..... F01C 21/00

[52] U.S. Cl. ..... 418/178; 418/179; 418/201.1

[58] Field of Search ..... 418/178, 179, 201.1, 418/202

[56] References Cited

U.S. PATENT DOCUMENTS

| | | | |
|---|---|---|---|
| 3,369,736 | 2/1968 | Coleman . | |
| 4,571,165 | 2/1986 | Murata | 418/178 |
| 5,011,389 | 4/1991 | Timoska | 418/178 |
| 5,060,531 | 10/1991 | Iguchi et al. | 418/178 |
| 5,165,881 | 11/1992 | Wicén | 418/201.1 |

FOREIGN PATENT DOCUMENTS

| | | |
|---|---|---|
| 0482592 | 12/1991 | European Pat. Off. . |
| 0460578 | 11/1992 | European Pat. Off. . |
| 1523558 | 4/1967 | France . |
| 1703782 | 7/1968 | Germany . |
| 61-190184 | 8/1986 | Japan . |
| 1-301977 | 12/1989 | Japan . |
| 2-75789 | 3/1990 | Japan . |
| 2-201072 | 8/1990 | Japan . |
| 2-301694 | 12/1990 | Japan . |
| 3-271586 | 12/1991 | Japan . |
| 3-290086 | 12/1991 | Japan . |
| 5-149287 | 6/1993 | Japan . |
| 5-332255 | 12/1993 | Japan . |
| 2013785 | 1/1979 | United Kingdom . |

OTHER PUBLICATIONS

"Energy Saving Clean Air System–Application of New Type Oil Free Screw Compressor–" (Hitachi Review vol. 65, No. 6 (1983) pp. 19 to 24).

"Latest Fluoropolymer Coating Technology", (Published by Epotec Co., Ltd.) pp. 8 and 104 and 304 (1989).

*Primary Examiner*—Richard A. Bertsch
*Assistant Examiner*—Charles G. Freay
*Attorney, Agent, or Firm*—Evenson, McKeown, Edwards & Lenahan

[57] ABSTRACT

Compressor bodies, an accelerator and a main motor are disposed on a base, while an intercooler, an aftercooler, an oil cooler and a coolant cooler are disposed perpendicular to the axial direction of the motor so that the directions, in which the tube nests of the gas coolers are drawn out, are made to be the same. A control panel having a maintenance display is mounted on a front panel composed of panel portions which are mounted pivotally around respective remote or opposite side ends. Portions to be inspected daily are disposed near the front panel and one side panel adjacent thereto. The compressor bodies including rotors that have been coated with a melted and solidified substantially homogeneous and continuous layer of a tetrafluoroethylene-perfluoroalkylvinylether copolymer that is substantially devoid of pinholes.

30 Claims, 23 Drawing Sheets

PACKAGE-TYPE SCREW COMPRESSOR HAVING COATED ROTORS

FIELD OF THE INVENTION

The present invention relates to a package-type screw compressor having an arrangement that a compressor body, a motor and auxiliary machines are accommodated in a box member thereof, a compressor of the foregoing type being for use as, for example, an oil-free air source in a general industrial plant. Moreover, the present invention relates also to coating for a screw rotor of a dry screw compressor. The gas to be compressed by the compressor may be air or gas other than air.

RELATED ARTS

A conventional package-type dry screw compressor has been formed into a package structure arranged such that a noise insulation cover is used to cover the overall body in order to prevent noise. A compressor of the foregoing type has been disclosed in, for example, "Energy Saving Clean Air System —Application of New Type Oil Free Screw Compressor—" (Hitachi Review Vol. 65, No. 6 (1983) p.19 to 24). A compressor 200 of the foregoing type has been, as shown in FIG. 15, arranged in such a manner that all of the following units required to operate the compressor 200 are disposed on a common base 201 and covered with a noise insulating cover 209: a main electric motor 202, a low-pressure- and a high-pressure-stage screw compressor bodies 204 and 205 to be operated by the motor 202 through an accelerator 203, an intercooler 206 for cooling low pressure of compressed air supplied from the low-pressure-stage compressor body 204 to the high-pressure-stage compressor body 205, an aftercooler 207 for cooling high pressure of compressed air discharged from the high-pressure-stage compressor body 205, and an oil supply device 208 for supplying oil for lubricating the bearings of the compressor bodies 205, 206 and gears of the accelerator 203 and the like. Further, a control panel including a microcomputer has been so attached to the noise insulating cover 209 that the operation of the compressor 200 is controlled by the control panel.

Although the screw compressor formed into the package structure as described above has advantages that the appearance can be improved and noise can be eliminated, it suffers from problems that the inner units cannot easily be maintained and inspected and a very wide maintenance space is required.

On the other hand, there arises a desire from users that labor costs are reduced by facilitating the maintenance and inspection operations.

Meanwhile, the dry screw compressor is so arranged that a male rotor and a female rotor are, in a non-contact manner, engaged with each other while maintaining a small gap by a synchronizing gear to compress air in a compression chamber in a casing thereof. Thus, the dry screw compressor has the small gap between the two rotors and that between the rotor and the casing and its compression chamber has no oil therein. Therefore, if rust is generated on the surface of the rotor during no operation of the compressor due to dew condensation of water in air, the rust serves to secure the surfaces of teeth of the male and female rotors to each other or the rotor(s) and the wall of the compression chamber to each other. As a result, there arises a problem in that a rotor-locking phenomenon occurs in which the rotor cannot be rotated.

Hitherto, a coating film has been, as a method of improving the corrosion resistance of the rotor, formed by fixedly applying, to the surface of the rotor, a solid lubricant, such as molybdenum disulfide (hereinafter called "$MoS_2$") or equally-granulated powder of tetrafluoroethylene (hereinafter called "PTFE") or the like.

For example, a MoS2 film has hitherto been formed by a process as shown in FIG. 19. That is, the shape of the screw rotor was machined to have predetermined dimensions followed by subjecting the surface of the teeth of the rotor to cleaning and degreasing 118, and followed by performing manganese phosphate treatment (immersion) 120. Then, the screw rotor was dried 122, and then a coating material containing $MoS_2$ as the main component was deposited 124 followed by performing baking processes 126 and 127. If necessary, the steps 124 to 128 shown in FIG. 19 was repeated to have a required film thickness to improve the corrosion resistance of the rotor. As a result, locking of the rotor taken place due to the corrosion was prevented.

However, the fact that the heat resistance of a binder for use in the $MoS_2$ coating material and that of a manganese phosphate film are about 200° C. raises a problem in that a long-time operation of the compressor under a temperature of air discharged from the compressor exceeding 200° C., deteriorates the corrosion resistance and, therefore, rust can be generated in the rotor due to water in air causing the rotor to be locked.

Therefore, a countermeasure must be taken such that an operation system is added which comprises a long-period-no-operation switch disposed in a control panel of the compressor and arranged to be switched on to operate, under unload condition with the suction valve closed, the screw compressor for about 20 minutes as to evaporate water in the compression chamber followed by automatically stop the operation.

A rotor having a coating layer of $MoS_2$ particles bound together by the binder of epoxy resin is also proposed (Japanese Patent Laid-Open (Unexamined Publication) No. 2-201072).

As the technology of a type arranged such that a coating film is formed on the surface of the base of the rotor, there has been disclosed a rotor comprising the rotor base made of synthetic resin and a surface layer of ethylene-ethylene tetrafluoride copolymer directly or indirectly reinforced by carbon fiber (see Japanese Patent Laid-Open Nos. 2-75789 and 1-301977). Further, there was disclosed a rotor comprising the base of the rotor, a corrosion-resisting coating layer thereon and a solid lubricant surface layer (see Japanese Patent Laid-Open No. 2-301694). Another rotor was proposed which comprises a base of spheroidal graphite cast iron, an electroless nickel plating layer, polyphenylene sulfide resin layer and a surface layer of organic resin such as epoxy resin (see Japanese Patent Laid-Open No. 3-290086). Further, there was proposed a rotor comprising a base of aluminum or magnesium alloy or the like and a thermo-setting resin layer on-the base (Japanese Patent Laid-Open No. 3-271586).

Japanese Patent Laid-Open No. 61-190184, for example, teaches the thickness of the coating layer to be formed on the base of the screw rotor.

SUMMARY OF THE INVENTION

An object of the present invention is to facilitate a daily inspection work and a maintenance and inspection work required for a package-type screw compressor and to minimize a required maintenance space and an installation space.

Another object of the present invention is to prevent air discharged at the time of unload-operation of a compressor from flowing into a passage through which cooling air discharged from a motor flows.

Still another object of the present invention is to prevent generation of rust on screw rotors and to prevent locking of rotors in a gas compression chamber due to the rust.

In order to achieve the foregoing objects, the present invention has an arrangement that portions of the compressor to be inspected daily are disposed near the front panel and one side panel adjacent thereto.

The front panel may be composed of two door panels, one of which may have a display or indicator unit on the surface thereof to display or indicate a maintenance time and a time at which maintenance should be performed. The door panels may be opened around respective remote or opposite side ends. The two door panels may be joined together on a central frame between the two door panels and that the central frame may be removable when the door panels are opened.

The intercooler (more specifically, inter-compressor-body-cooler) and the after-cooler (more specifically after-compressor-body-cooler) may be adapted to have tube nests inserted thereto, the tube nest being permitted to be inserted/removed from the shell. The intercooler and the aftercooler may be so disposed that the directions, in which the tube nests are drawn out, are the same. The tube nests may be drawn out toward the front panel or the rear or back panel.

A caster enabling movements may be disposed below the gas coolers (intercooler and aftercooler) as to be moved on rails disposed in the package.

An end cover of the gas cooler, that is, the intercooler and the aftercooler, may be structured to be rotative around hinges of the shell.

The coolant cooler and the oil cooler may be disposed so that the direction, in which the coolant cooler and the oil cooler are drawn out, is the same as the direction in which the tube nests of the intercooler and the aftercooler are drawn out.

The suction duct may be structured to slide in the direction toward the one side panel at the time of removal thereof. A beam enabling sliding may be disposed to extend toward the one side panel.

The suction duct and the air inlet of the compressor may be connected by an elbow made by rubber so as to be easily detached.

A mounting seat for supporting a supporting column for a maintenance crane may be formed in the package. The mounting seat may be disposed on the base at any one of the four corners of the package. A pole crane or a part of the same may be previously disposed at one or more portions of the mounting seats.

An air discharge duct for discharge air upon unload operation of the compressor bodies may be disposed in a duct for discharging motor cooling air to allow the motor cooling air to flow around the air discharge duct so that discharged air and motor cooling air are discharged separately to the atmosphere.

A preferred embodiment of the present invention has an arrangement that the low-pressure and high-pressure-stage screw compressor bodies and the main motor are respectively fixed to the casing of the accelerator in a cantilever manner, while shafts of the compressor bodies and the motor are connected to each other through accelerating gears. The axial line of the screw or the motor extends parallel to the front panel. The intercooler is disposed in a space below the compressor bodies, the aftercooler is disposed above the accelerator. The oil cooler and the coolant cooler are disposed below the motor. The longitudinal direction of each of the coolers is made to be perpendicular to the axial line of the motor or compressor bodies. The suction duct is disposed above the compressor bodies between the aftercooler and one side panel, and a control panel is mounted on the front door panel at a portion thereof opposing to the main motor. Further the drain discharge port of the gas (air) coolers is disposed at a side of the side panel.

The front panel and one side panel adjacent thereto are selected or designed to be sides from which daily inspections are performed, wherein an oil-level meter, an oil supply port, an oil filter and a drain detection valve and preferably a motor-grease supply port are disposed near the daily inspection sides. As a result, a person for performing the daily inspection can complete the inspection work in the vicinity of the aforesaid sides to be inspected daily. As a result, the inspection can be facilitated and the time taken to complete the work can be shortened.

Since the portions to be inspected daily are concentrated on the two sides, the space to perform the inspection is required in front of the foregoing two sides. Therefore, the inspection can easily be performed even if the installation space is limited or even if the installing direction is limited.

In the case where the front panel is composed of the two door panels (front panel portions) arranged to be opened around respective remote or opposite side ends, the front panel portion can by fully opened. Therefore, the maintenance and inspection work can be facilitated. When the center panel is adapted to be removed, the maintenance and inspection work can further be facilitated and the work for removing or taking out inner units can be performed easily.

Since the tube nest of the air cooler is drawn out in the longitudinal direction of the cooler, a space for the length of the tube nest is required in the longitudinal direction of the cooler to completely remove the tube nest. When the intercooler and the aftercooler are removed in the same direction, the overall maintenance space can be reduced because the tube nest removing space can be concentrated only in front of one panel. If the tube is removed in the space in front of the front panel, the inspection space and the maintenance space can be used commonly. Therefore, the space required to install the compressor can be reduced. If necessary in terms of the installation space, the inspection space before the front panel may be minimized and a space before the opposing or rear panel portion may be utilized as the maintenance space and the cooler tube nest may be removed toward the rear panel.

In the case where the caster is disposed below the gas cooler and the overall body of the gas cooler can be taken out in the longitudinal direction of the cooler, the maintenance of the gas cooler can be performed avoiding contamination of the inside portion of the package by cooling water.

A cover also serving as a drain separator at the end of the air cooler is opened at the time of removing the tube nest or performing the inspection of the cooler tube. When the cover is opened/closed around a hinge fixing the cover to the shell, the cover can be opened or closed by removing a bolt for fixing the cover to the shell and by removing the pipes. Therefore, individually hoisting the cover by a crane is not required and, accordingly, the cooler maintenance and inspection work can be performed easily.

In the case where the coolant cooler and the oil cooler are also disposed so that their longitudinal direction is the same as that in which the tubes of the intercooler and the aftercooler are removed, the space for removing and maintaining the coolant cooler and the oil cooler can be commonly used with the space required for the maintenance of the air coolers. Therefore, the space required to install the compressor can be reduced.

Since the suction duct is, in the package, disposed above the compressor bodies, it should be removed at the time of performing the maintenance and inspection work. When the suction duct is formed into a separate box shape and it is mounted in the noise insulating cover to be slideable toward the side panel portion, the suction duct can be removed easily without a necessity of hoisting it from an upper position. Therefore, the maintenance and inspection work can easily be performed.

The structure in which the suction duct and the air inlet of the compressor are connected to each other by the rubber elbow facilitates mounting and removal.

Although equipment, such as a crane, is required to remove or take out the units at the time of performing the maintenance and inspection work, the equipment, such as the crane and an I-beam are not sometimes installed in the user's site of-the compressor. However, the structure having, in the package thereof, a mounting seat previously formed for the purpose of supporting a supporting column for holding the maintenance crane serves to eliminate the necessity of additionally installing the crane. A movable crane which can be decomposed is sufficient to satisfactorily perform the maintenance work. Therefore, the cost to build the working building or construction can be reduced. When, the compressor is adapted for the use of a pole crane with one supporting column to be mounted on one of the mounting seats, the units in the package can be removed by simply removing portions of the noise insulating cover at the time of performing an inspection work such as the work for maintaining the auxiliary units for the compressor bodies. Therefore, the time taken to complete the maintenance work can be shortened.

When air discharged upon the unload operation of the compressor and air which has cooled the motor are separately discharged, the fear of the flow of hot discharged air toward the motor can be eliminated. A structure, in which motor cooling air flows around the duct for the discharged air, enables to cool hot air-discharge duct, and to eliminate noise generated through a side surface of the air-discharge duct at the time of switching the mode between the un-load operation and on-load operation. A structure in which ports for discharging air, which has cooled the motor, are disposed around the port for discharging air from the compressor bodies enables to lower the temperature of hot air discharged from the discharge port of the compressor bodies.

In the case where the main motor and the compressor bodies are respectively fixed to the casing of the accelerator in the cantilever manner, the longest (longitudinal) length in the package is the total length of the main unit comprising the main motor, the accelerator and the compressor bodies. Therefore, it is preferable that the main unit is disposed to extend parallel to the front panel and that an intercooler also serving as a connection pipe between the low-pressure-stage compressor and the high-pressure-stage compressor is disposed in a space below the compressor bodies. At this time, the tube nest of the intercooler can be taken out without being blocked by the frames such as the frame at the bottom of the noise insulating cover when the height of the main unit is designed appropriately. It is preferable that the coolant cooler and the oil cooler are disposed in a space below the main motor and that the aftercooler is disposed above the accelerator. Since the discharge port of the high-pressure-stage compressor is opened upwards, the aftercooler also serves as a part of the discharge pipe. Therefore, the air discharge port of the package can be formed in an upper part of the side panel reduce the length of the discharge pipe in the package. It is preferable to dispose the suction duct in a space above the compressor bodies, remaining after disposition of the aftercooler above the accelerator. Further, it is preferable that the control panel is mounted to one, of the door panels of the front panel, adjacent to the motor, becomes the temperature of the motor and accordingly of the one door panel is relatively low. In a case where the drain discharge port of the air coolers is formed at a side or portion of, e.g. below or above the one side panel to which the cooling-water pipe and the air pipe are connected, pipes for the water supply system and air supply system can be concentrated on the one side panel portion. Therefore, the disposition in the package can easily be designed. If the units are disposed as described above, the space in the package can effectively be used and, accordingly, the size of the package can be reduced.

In order to achieve the foregoing still another object, the present invention is arranged so that primer coating is applied to lobes of screw rotors each having been machined to have a predetermined teeth profile, followed by performing drying and baking. Then, a coating material comprising tetrafluoroethylene-perfluoroalkylvinylether copolymer (referred to hereafter as "PFA") is uniformly deposited or applied, followed by performing drying and baking to form a PFA coating film or layer on the surface of the rotor lobes so that the rust generation on the rotor is prevented.

It is preferable that the PFA coating film is formed by steps of: applying a primer coating solution, in which PFA particles, a binder, pigment and water are mixed and dispersed, to the surface of the rotor base, followed by performing drying and baking; and applying a PFA coating solution made of PFA particles, binder and pigment dispersed in water, followed by performing drying and baking up to a temperature where the PFA particles on the rotor base are melted to form a continuous coating film.

If the PFA coating is applied, the surface of the rotor base is covered with a uniform PFA film in which the melted PFA particles form continuous layer, pin holes cannot easily be formed. Therefore, a significant rust prevention effect can be obtained even by a thin thickness (50 μm or thinner) of the PFA film. Since the PFA particles are melted to form uniformly integrated layer after solidification, there is not a fear of deterioration of the coating film due to drop of the granular powder.

Since the PFA has non-adhesive characteristic, foreign matter, such as dust in air, having invaded into a small gap between the male rotor and the female rotor or between the rotor and the casing can easily be removed. Therefore, a problem of locking of the rotor(s) due to accumulation of the foreign matter can be prevented.

As described above, the PFA coating applied to the rotor of the dry screw compressor enables to minimize generation of rust on the rotor. Therefore, locking due to rust generated in a small gap between rotors or between the rotor and the casing can be avoided. As a result, locking of the rotor due to rust can be avoided.

Other and further objects, features and advantages of the invention will be appear more fully from the following description.

DETAILED DESCRIPTION OF PREFERRED EMBODIMENTS

Figure 1:
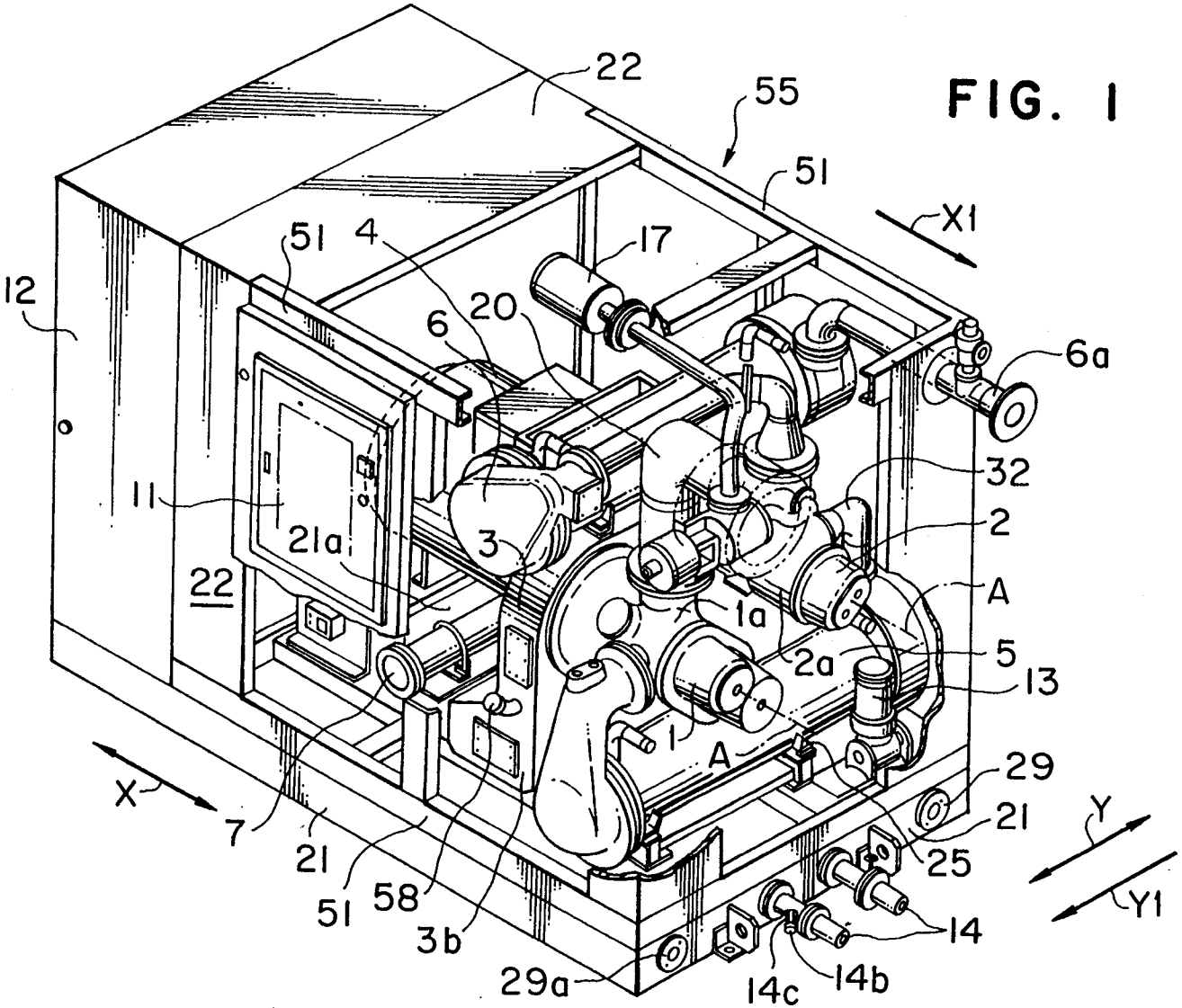
FIG. 1 is a perspective view which illustrates an arrangment of internal units of a package-type screw compressor according to an embodiment of the present invention.
Figure 2A:
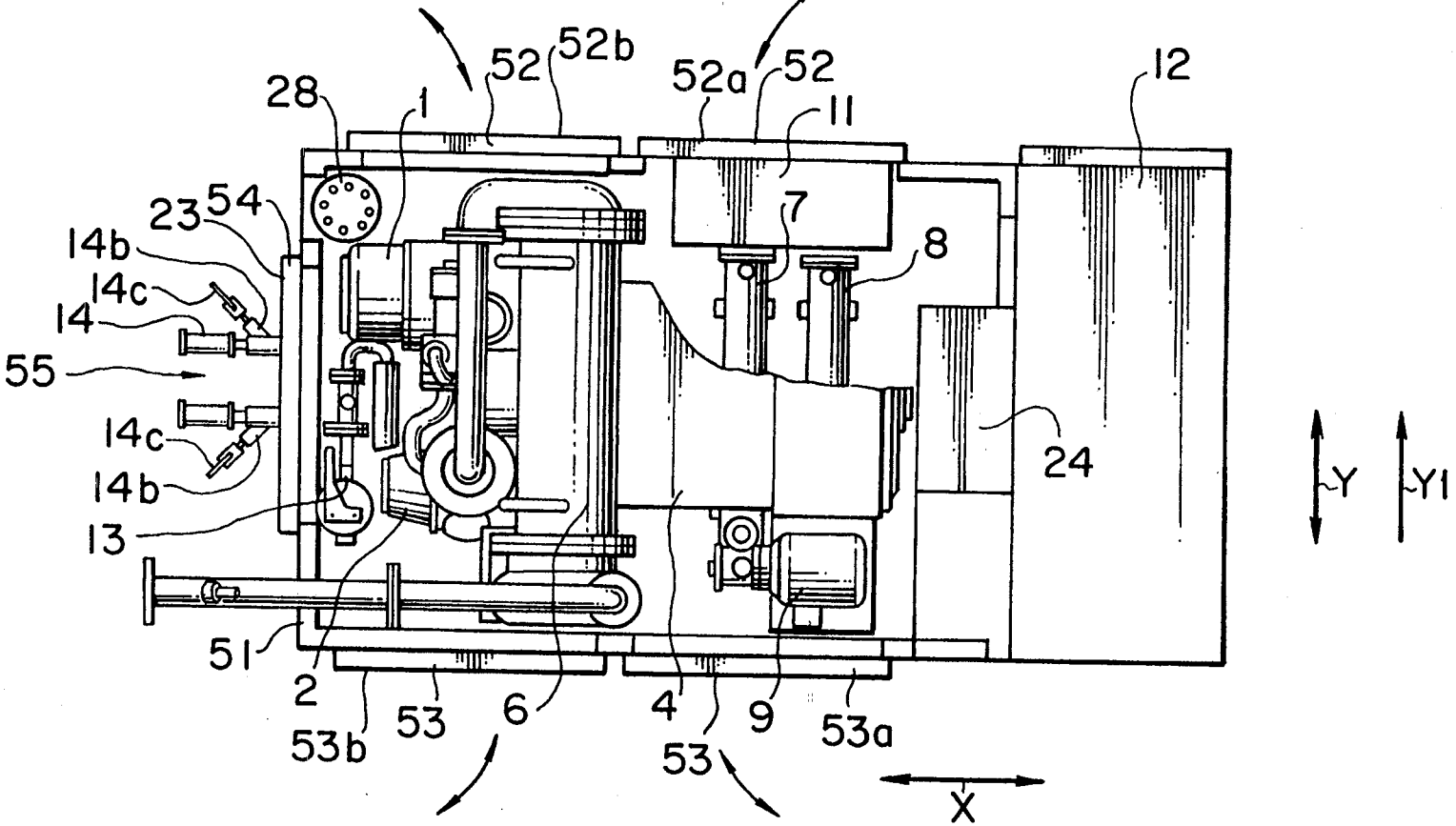
FIG. 2A is a plan view which illustrates the arrangement of the internal units of the compressor shown in FIG. 1.
Figure 2B:
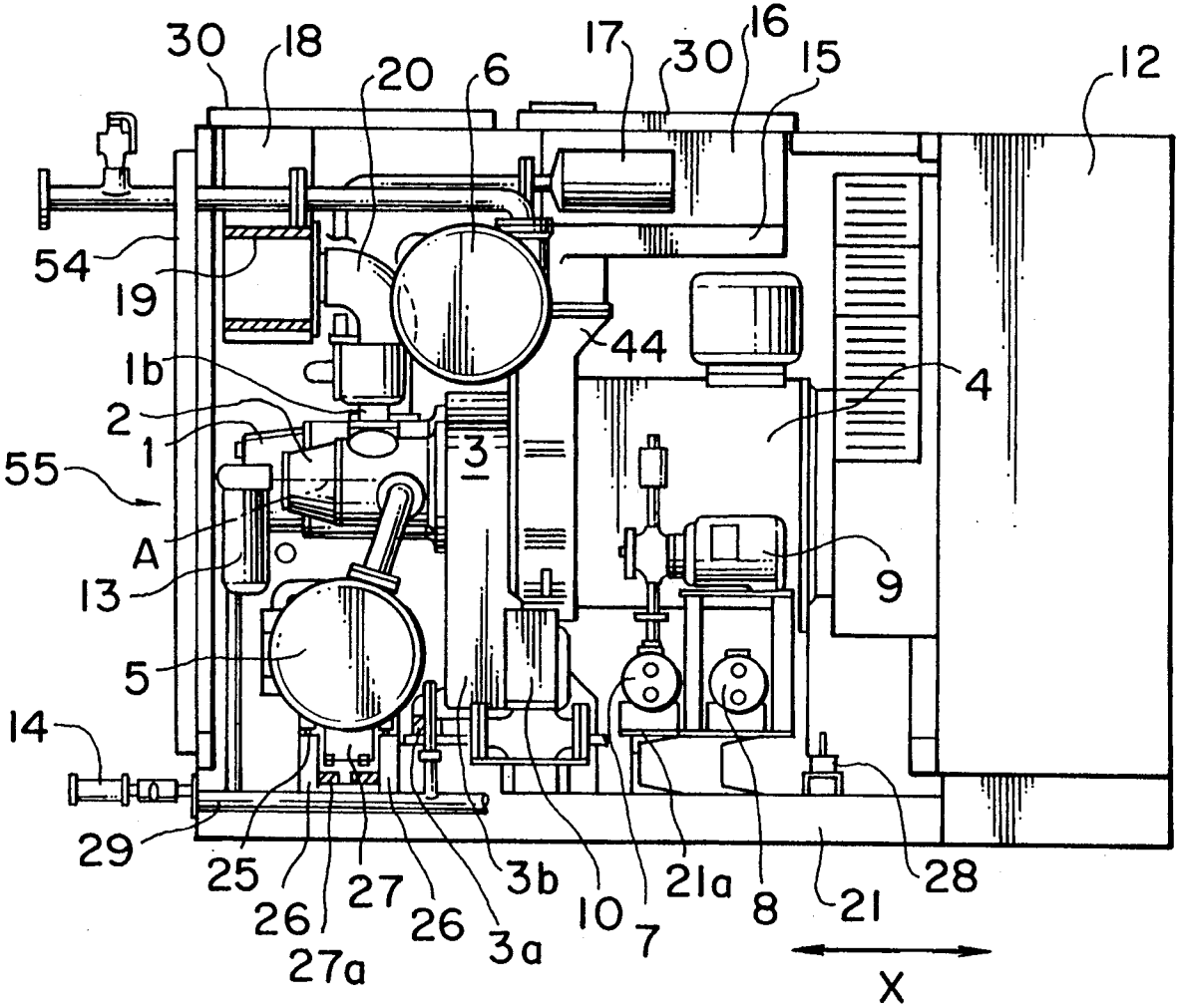
FIG. 2B is a back or rear view of the arrangement shown in FIG. 2A.

The outline of a package-type screw compressor according to a preferred embodiment of the present invention will now be described with reference to FIGS. 1, 2A, 2B and 3.

An accelerator 3 is disposed on a compressor package base 21 while interposing a vibration-insulating rubber 3*a*. A low-pressure-stage-compressor (main body) 1 and a high-pressure-stage-compressor (main body) 2 fastened to the accelerator 3 in a cantilever manner. A main motor 4 is a flange-type motor secured, in a flange portion of a case thereof, to the accelerator 3. The foregoing units 1–4 are so disposed that center line A of rotational shafts coincides with a longitudinal direction X of the base 21. In a space below the low-pressure-stage-compressor 1 and the high-pressure-stage-compressor 2, an intercooler (more specifically, inter-compressor (body)-cooler) 5 is disposed which cools low-pressure of compressed air discharged from the low-pressure-stage-compressor 1 and serves as a connection pipe for establishing the connection between the two compressors 1 and 2. The intercooler 5 has casters 25 in leg portions thereof to roll on rails 26 disposed on the base 21 so that the intercooler 5 can be slidingly drawing out or removed in a direction Y at the time of the maintenance work. The intercooler 5 is usually secured to the base 21 while interposing a bracket 27 and vibration-insulating rubbers 27*a* in a state where the casters 25 are not in contact with the rails 26 (in a state designated by a solid line shown in FIG. 4A). When a nut 27*b* is loosen to move the intercooler 5 downwards, the bracket 27 is also moved downwards to a position designated by an imaginary line shown in FIG. 4A, so that, the casters 25 can be placed on the rails 26. An after-cooler (more specifically, after-compressor (body)-cooler) 6 for cooling high-pressure of compressed air discharged from the high-pressure-stage compressor 2 is secured at a position above the accelerator 3 while interposing a vibration-insulating rubber. As to be described later with reference to FIG. 9, the intercooler 5 and the aftercooler 6 are shell-and-tube type coolers each of which is so arranged that an integrated-type tube-nest structure 35*c* composed of baffles 35*a* and a coolant tube 35*b* is accommodated in an outer shell 35. A tube plate (end plate) 33 disposed on one side is a movable plate with some play so that a structure is formed which enables the tube nest 35*c* to be drawn out or removed in the direction Y at the time of the cleaning work. The two coolers 5 and 6 are disposed so that the tube nest 35*c* of the intercooler 5 and that of the aftercooler 6 are drawn out or removed in the same direction Y. In a space below the main motor 4, there are disposed an oil cooler 7 for cooling oil, which lubricates bearings of the compressors 1 and 2 and the gears of the accelerator 3, and a coolant cooler 8 for cooling a coolant composed of anti-freezing fluid for cooling jackets 1*a* and 2*a* of the compressor bodies 1 and 2. The oil cooler 7 and the coolant cooler 8 are so disposed that their longitudinal directions are perpendicular to the direction X of the output shaft of the main motor 4. An oil pump 9 for supplying the lubricating oil is disposed above the oil cooler 7 and the coolant cooler 8 so that the drawing-out or removals of the oil cooler 7 and the coolant cooler 8 are not interrupted. An oil filter 13 positioned in a passage, through which the oil cooled by the oil cooler 7 is supplied, is disposed adjacent to the low-pressure-stage compressor 2. The coolant cooler 10 is disposed in a region below the aftercooler 6 and on the side of the accelerator 3.

All the foregoing units are covered with a box-shaped noise-insulating cover 22. The noise-insulating cover 22 is attached and fixed to a multiplicity of outer peripheral frames 51, which are directly or indirectly fixed to the base 21 and constitutes the frame of the box 50, and to a starting-panel 12 disposed on the base 21 and defining a part of front surface of the box 50. One or more (movable) front-panel(s) 52, back panel(s) 53, side panel(s) 54 and ceiling panel(s) 30 and a motor-air suction duct 24 are attached to the noise-insulating cover 22. Although the noise-insulating cover 22 is a kind of a panel, it is different from the panels 52, 53 and 54 because the noise-insulating cover 22 are not movable with respect to the frame 51. A control panel 11 is attached to one of movable panels 52*a*, 52*b* constituting the front panels 52, that is, it is attached to a door panel 52*a*. The door panels 52*a*, 52*b*, 53*a* and 53*b* constituting the front panels 52 and the back or rear panels 53 opposite to the front panels 52 are so mounted in a hinged manner at respective remote side ends.

A suction or intake duct 18 for sucking air into the low-pressure-stage compressor (body) 1 is disposed between the aftercooler 6 and the side panel 54 at a position above the compressor bodies 1 and 2 as will be described later in detail with reference to FIG. 11. The suction duct 18 is attached to a portion of the frame 51 of the noise-insulating cover 22 in such a manner that the suction duct 18 can be slid in the direction X to be drawn out or removed through the side panel 54. A suction filter 19 is disposed in the suction duct 18, the suction filter 19 being connected to a suction port 1*b* of the low-pressure-stage compressor 1 while interposing a rubber elbow 20. A motor-air discharge duct 15 is disposed above a discharged port, through which air for cooling the main motor 4 to be cooled by included fan (not shown) is discharged. The discharge duct 15 is fastened to a portion of the frame 51 of the noise-insulating cover 22, the discharge duct 15 having an upper surface covered with the ceiling panel 30 having air-discharge louvers 46 to be described later in detail with reference to FIGS. 12A and 12B. The motor-air discharge duct 15 includes therein an air-discharge chamber or duct 16 for accommodating an air-discharge silencer 17 for air discharged from the compressors 1 and 2 at the time of unload-operating the compressor bodies 1 and 2 so that air discharged from the motor 4 and compressor discharged air are discharged outside the package without joining together.

A seat 28 for a crane for the maintenance work is formed on a top surface of the base 21. The seat 28 in a corner of the front panel 52 side with the side panel 54 side also serves as a seat for fastening a pole crane 36 for easy maintenance and inspection as will be described later in detail with reference to FIG. 10.

Air sucked through the suction port of the ceiling panel 30 passes through the suction duct 18, the suction filter 19 and the rubber elbow 20, and then air passes through a capacity adjustment valve (not shown) before it is sucked into a low-pressure-stage compressor 1. Air compressed by the low-pressure-stage compressor 1 is cooled by the intercooler 5, and compressed to a specified pressure level by the high-pressure-stage compressor 2. Then, the pressurized air is cooled by the aftercooler 6 to be discharged through a discharge pipe 6*a*. Air discharged by the compressors 1 and 2, when the compressors 1 and 2 are unload-operated, flows through a discharge silencer 17, into the discharge duct 16, and then it is discharged outside the package through the louver 45 (see FIG. 12A) of the ceiling panel 30. Drain generated in the air coolers 5 and 6 is discharged through a drain discharge port 14 of a drain discharge pipe 14*a* in the base 21 below the side panel 54. A branch pipe 14*b* is connected to the drain discharge pipe 14*a*, the branch pipe 14*b* is provided with a drain detection valve 14*c* for checking whether or not drain passes through the discharge pipe 14*a*.

Figure 3:
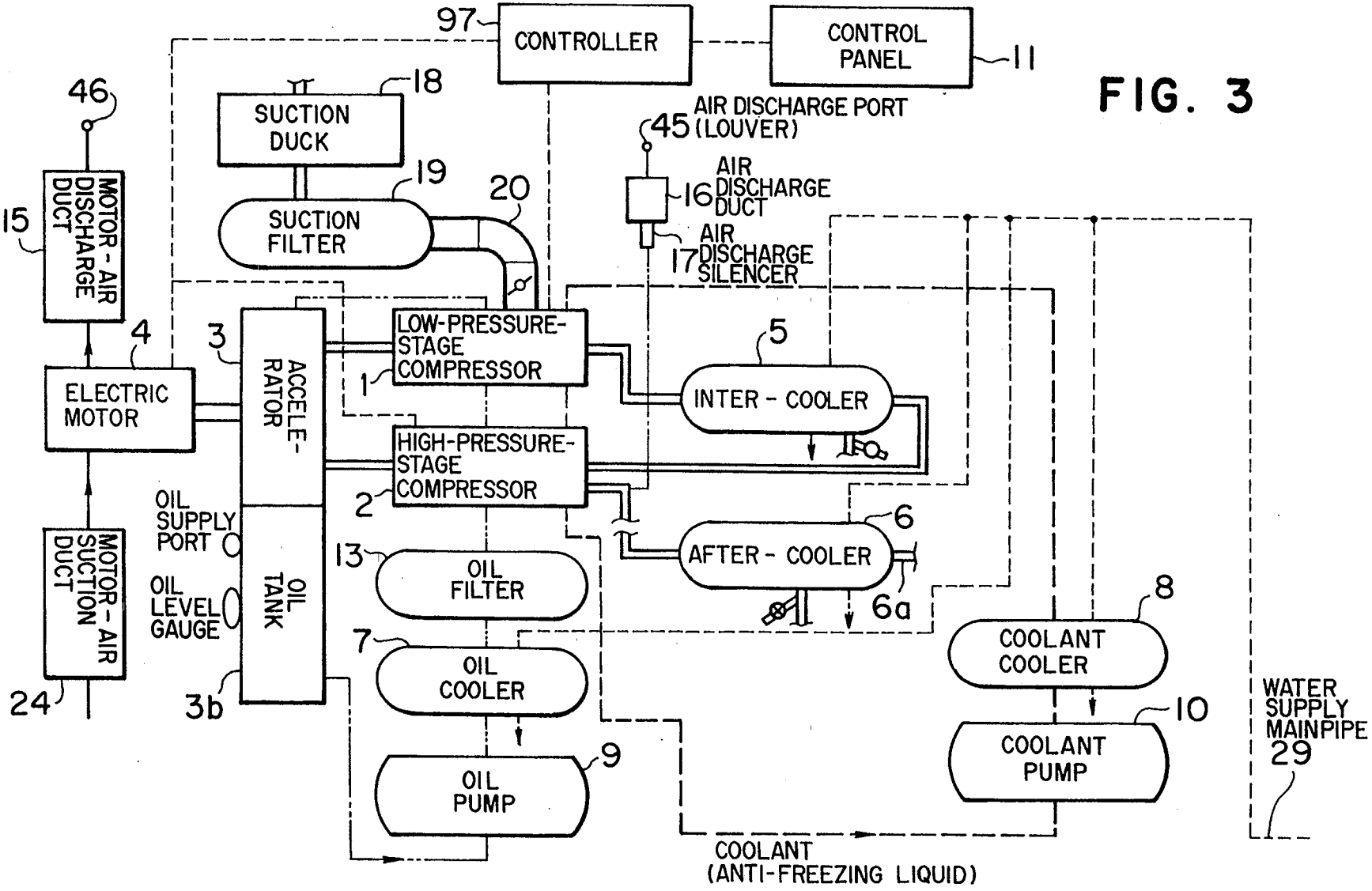
FIG. 3 is a block diagram which illustrates functional relationship of the units of the compressor shown in FIG. 1.

As mainly shown in FIG. 3, the low-pressure-stage compressor 1 and the high-pressure-stage compressor 2 are operated by the main motor 4 by way of the accelerator 3. The main motor 4 incorporates therein the fan (not shown) for sucking cooling air from the outside of the package, that is, the box member 50 via a motor suction duct (not shown). Hot air that has cooled the motor 4 passes through the motor-air discharge duct 15 to be discharged to the outside of the package 50 through the louver 46 (see FIG. 12A) of the ceiling panel 22. The motor air-suction duct and the motor-air discharge duct 15 have noise absorber 47 (see FIGS. 12A and 12B) applied to the inner surfaces thereof so that noise leakage to the outside of the package 50 can be minimized.

The lower portion of the accelerator 3 serves as an oil tank 3*b*. The lubricating oil sucked from the oil tank 3*b* by an oil pump 9 is cooled by the oil cooler 7 before it passes through the oil filter 13 to be distributively supplied to the bearing portions or the like of the compressor bodies 1 and 2 and to the gears of the accelerator 3. The oil filter 13 of the foregoing units in the oil-lubricating system, that should be inspected daily, is disposed adjacent to the side panel 54, while the oil cooler 7, that is considered to be maintained and inspected secondly-frequently, is disposed on a bed 21*a* formed on the base 21 to be solely slidingly drawn out or removed on the bed 21*a*.

The coolant for cooling jackets 1*a* and 2*a*of the compressor bodies 1 and 2 is circulated by a coolant pump 10, and it is cooled by cooling water in the coolant cooler 8.

Cooling water supplied from the outside of the package 50 is distributively supplied from a main water-supply pipe 29 disposed on the base 21 to the intercooler 5, the aftercooler 6, the oil cooler 7 and the coolant cooler 8. Cooling water, which has received heat in each of the coolers 5 to 8, is gathered into the main water-discharge pipe 29*a* to be discharged to the outside of the package 50. The oil cooler 8 may be cooled with the coolant cooled by the coolant cooler 7. In this case, cleaning of the oil cooler 8 can be almost omitted so that the maintenance cost can be reduced.

By constituting the package-type screw compressor (assembly or apparatus) 55 as described above, the space in the package or box 50 can be used effectively to reduce the size of the package 50 so that the space required to install it is minimized. Further, the maintenance and inspection operationality can be improved.

Figure 4:
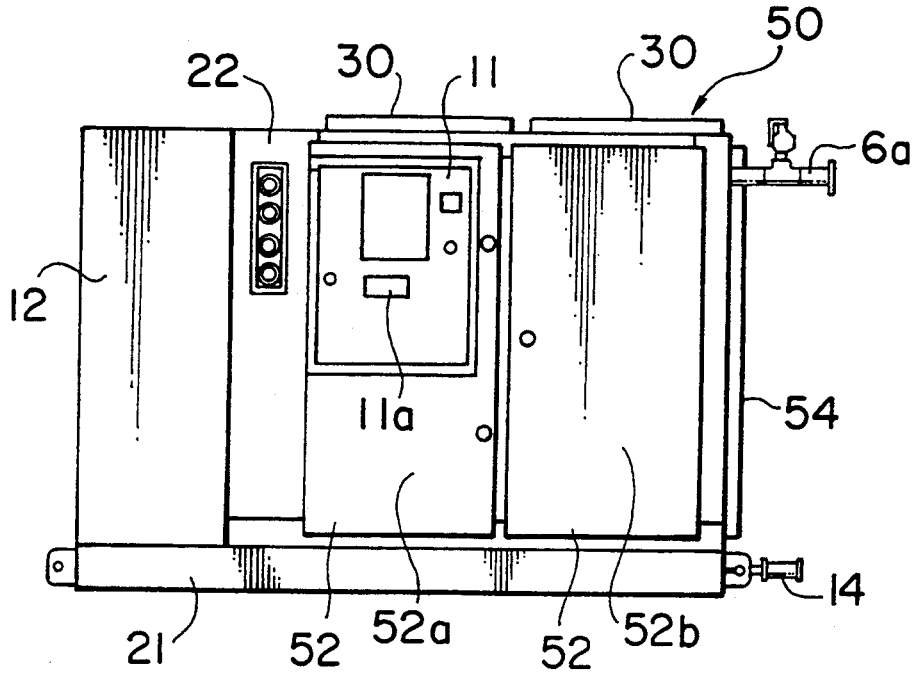
FIG. 4 is a front elevational view, which illustrates an outer appearance of the package, of the compressor shown in FIG. 1.
Figure 5:
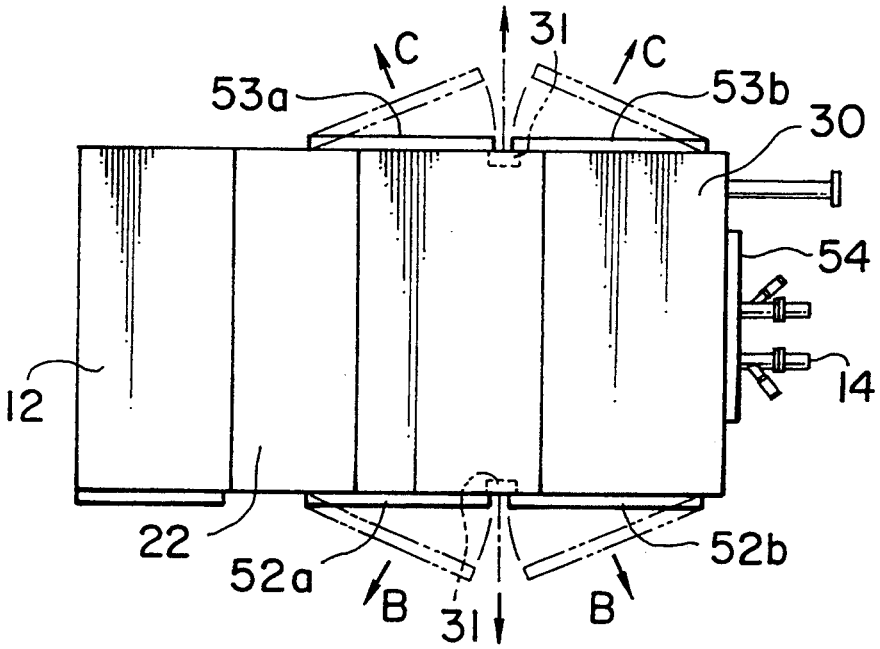
FIG. 5 is a plan view which illustrates states where a door panel of the compressor shown in FIG. 1 is opened/closed.
Figure 4A:
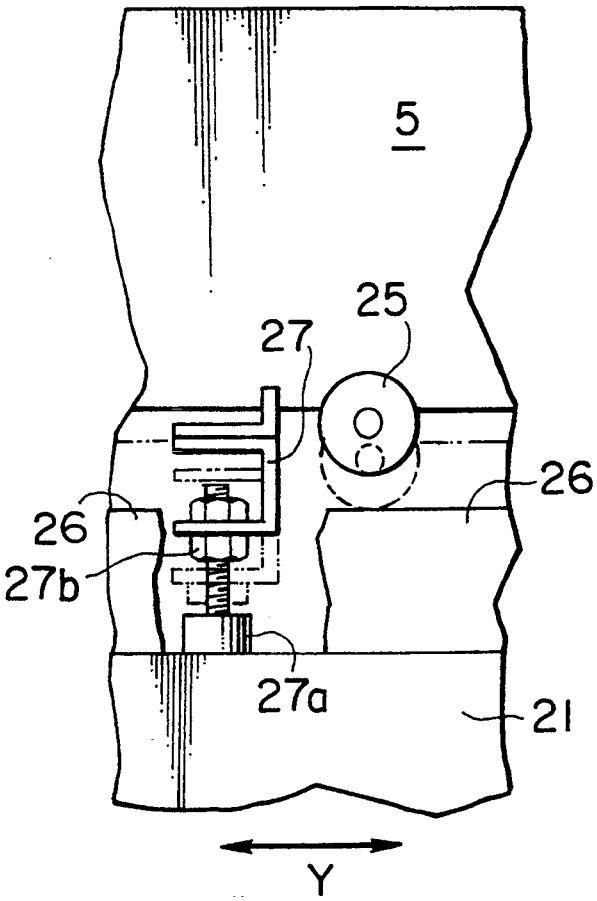
FIG. 4A is an explanatory view which illustrates a structure for supporting an air cooler by a bracket.
Figure 4B:
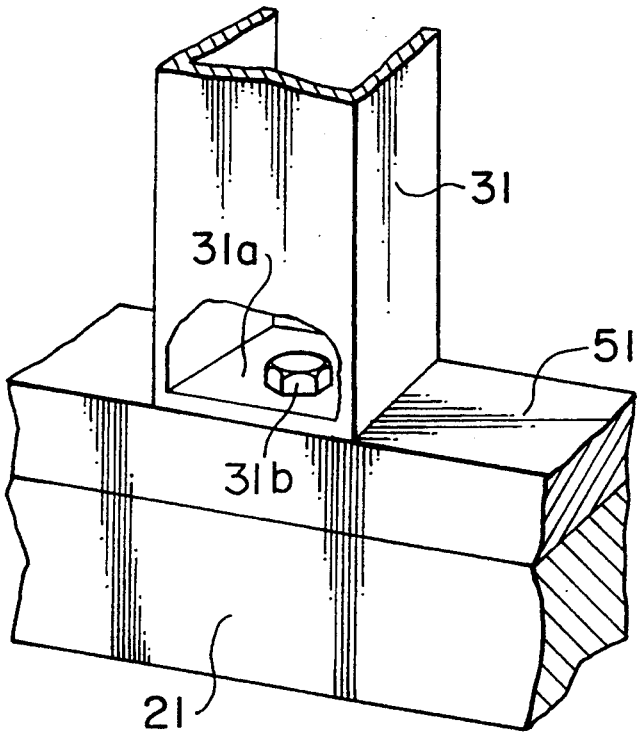
FIG. 4B is an explanatory view which illustrates an example of a structure of a center frame detachably attached to an outer frame.

Referring now to FIGS. 4 and 5, the front panels and the back or rear panels respectively comprises two door panels 52 (52*a*and 52*b*) and 53 (53*a* and 53*b*), the two door panels 52*a*and 52*b* (53*a* and 53*b*) are, as designated by the imaginary line shown in FIG. 5, mounted to the frame 51 of the noise-insulating cover 22 in the hinged manner at respective remote side ends. When the door panels 52*a*, 52*b* , 53*a* and 53*b* are closed, they are fastened to a center frame 31 which is a frame arranged similarly to the outer peripheral frame 51. As shown in, for example, FIG. 4B, the center frame 31 is formed into a U-shape column having an end wall 31*a*. The end wall 31*a* is detachably secured to the adjacent outer peripheral frame (in this case, the bottom outer peripheral frame) 51 by a bolt 31*b*. When the door panels 52 and 53 are opened, the center frame 31 can easily be removed. Therefore, the maintenance and inspection works can easily be performed.

The control panel 11 is fastened to one (52*a*) of the door panels 52*a*and 52*b* at the front side. The outer surface of the control panel 11 serves as a part of the outer surface of the box member 50. The definition that the units are substantially accommodated in the box member 50 includes a fact that the control panel 11 and the like serve as a part of the box member 50. The control panel 11 has the following functions, such as, starting and stopping functions of the compressor apparatus, a digital display or indication function for displaying or indicating temperature, pressure, electric current, operation time, number of starting times and number of unload-operation times, a function for displaying or indicating a critical failure and a not-critical failure and a protection function such as an emergency stop. Further, the control panel 11 has operation-control functions such as energy-saving operation by automatically setting the capacity-adjustment pressure, an automatic stop function effected at the time of continuing the unload operation for a long time, an automatic stop taken place when the line pressure has been lowered, and a schedule-operation. In addition, the following prevention and securing functions are possessed: a cooler cleaning display or indication function depending upon the results of comparison calculations of the temperature of cooling water for the cooling devices such as the air coolers 5 and 6 and the oil cooler 7 with the temperature of the fluid to be cooled, the contamination detection and cleaning display or indication functions realized by making use of the pressure loss occurring in the air filter 19 and the oil filter 13 and the pressure level of the same, and a display or indication function of the time at which grease for the motor 4 should be supplied. Moreover, the following functions are possessed: a function of displaying the time at which the sub-unit or auxiliary devices for the compressor bodies 1, 2 should be inspected and the time at which the main bodies 1 and 2 should be inspected and a function 11*a* of displaying the time taken to the moment at which the inspection should be performed. The management of the inspection time is made depending upon both operation time of the compressor bodies 1 and 2 and the time which has passed from the installation. A function is possessed with which the inspection time has come is displayed or indicated when the regulated hours of the operation time or regulated years, after the installation that have passed first, have passed. If a trip takes place due to a failure, operation data, such as the temperatures of the portions immediately before the trip, is stored so that operation data just before the trip is displayed or-indication on the panel even after the operations of the compressors 1 and 2 have been stopped. Some of the above-mentioned controls of the control panels 11 have been disclosed in EP-A1-0 482 592 and EP-A1-0 460 578.

The set value of the pressure for adjusting the capacity can arbitrarily be set on the panel 11. Software is so constituted that pressure higher than a certain pressure level cannot be set in order to avoid the fact that the upper limit of the pressure does not exceed the allowable pressure for the compressor. The upper limit pressure level is prevented to become lower than the lower limit pressure level if one of the set values has been changed. When the pressure difference between them has been reduced to a value lower than a certain value, the other set value is automatically changed to maintain the minimum allowable pressure difference. If the set value has been automatically changed, the change is displayed or indicated by blinking display.

An example of the capacity adjustment of the compressor (apparatus) 55 and setting control of the set value of the pressure for automatic start upon the drop of the line pressure will now be described with reference to FIGS. 13, 13A to 13D and 14.

Figure 13:
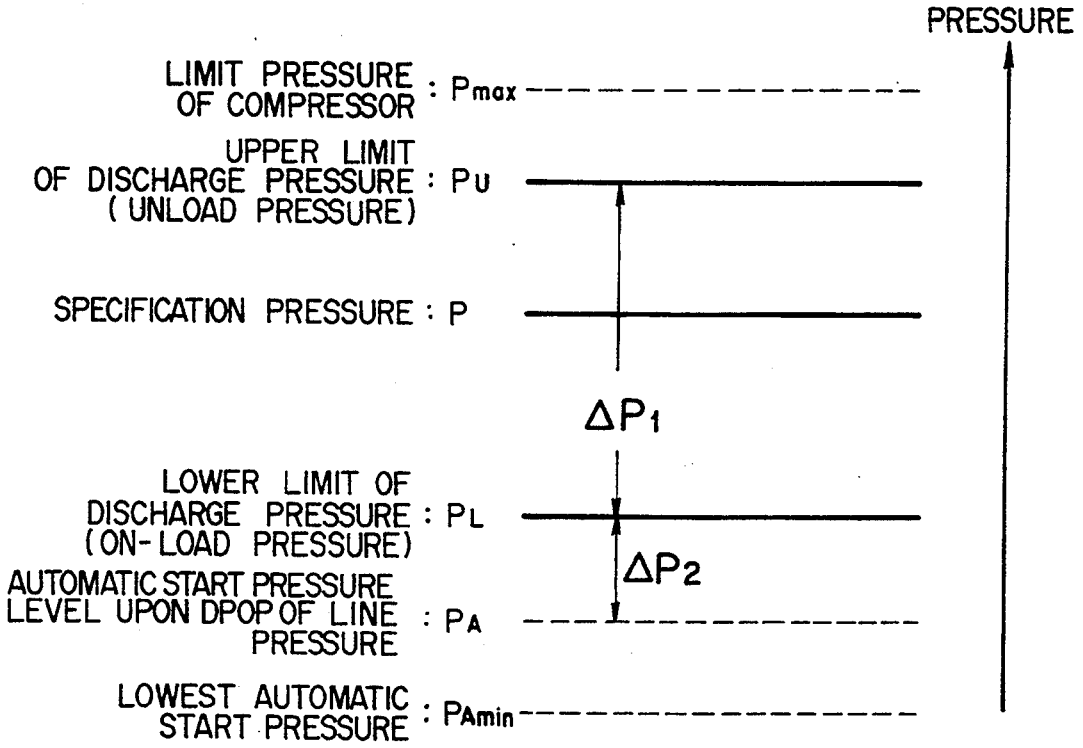
FIG. 13 is an explanatory view for illustrating various pressure reference levels.
Figure 13A:
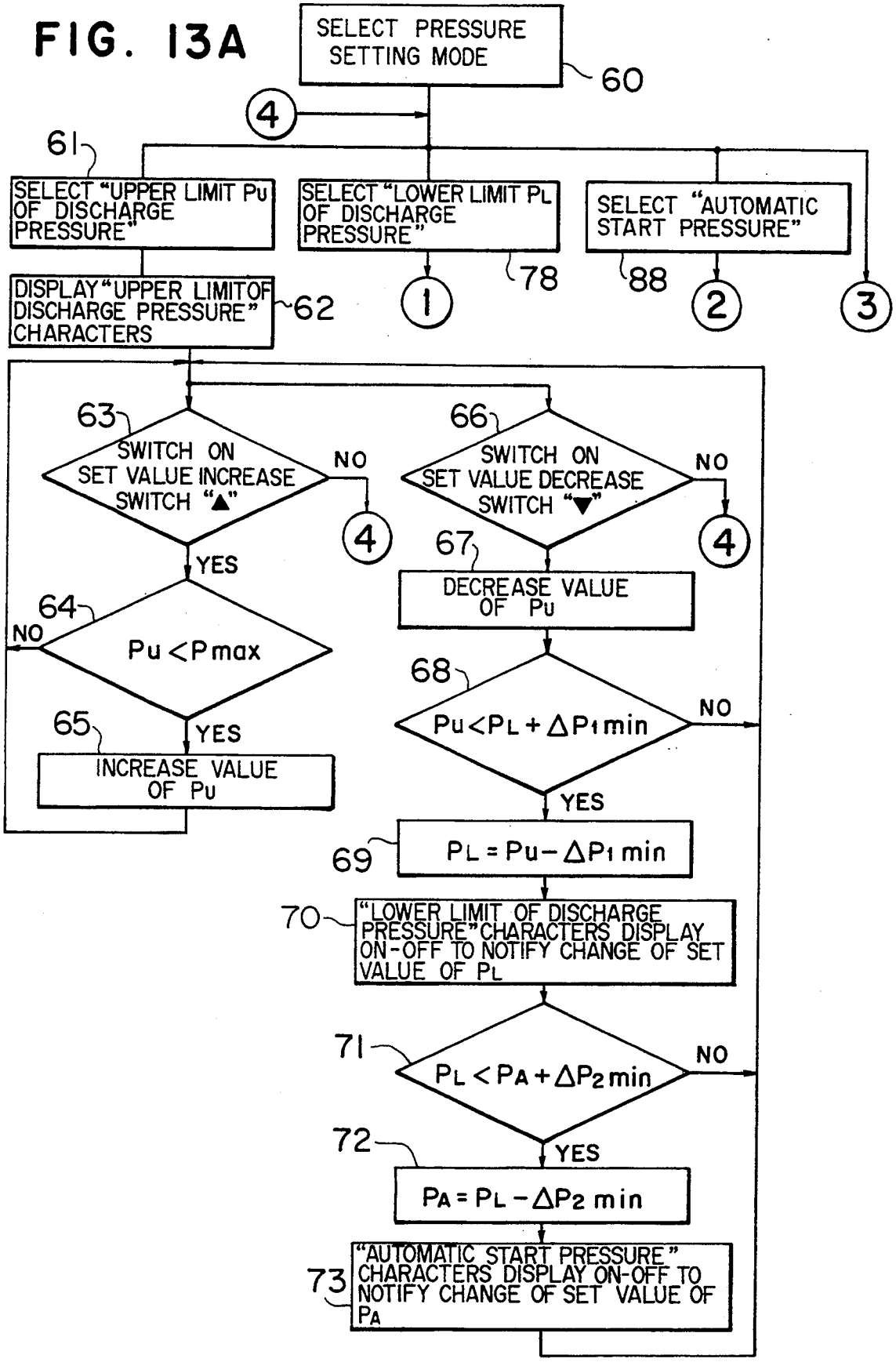
FIGS. 13A to 13D are flow charts for adjusting the capacity of the compressor and for setting and controlling the pressure level for automatic start effected if the line pressure has been lowered.
Figure 13B:
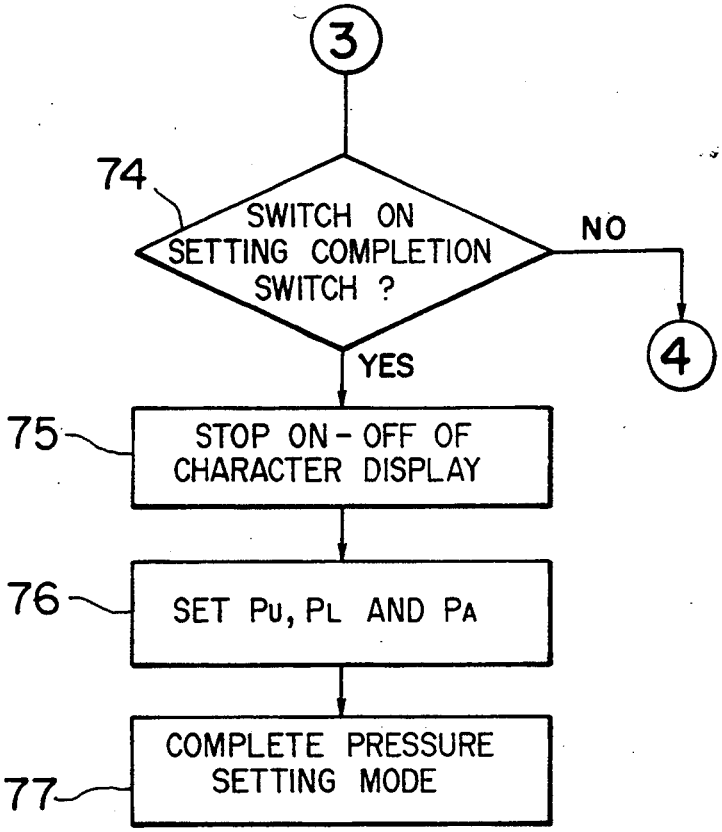
Figure 13C:
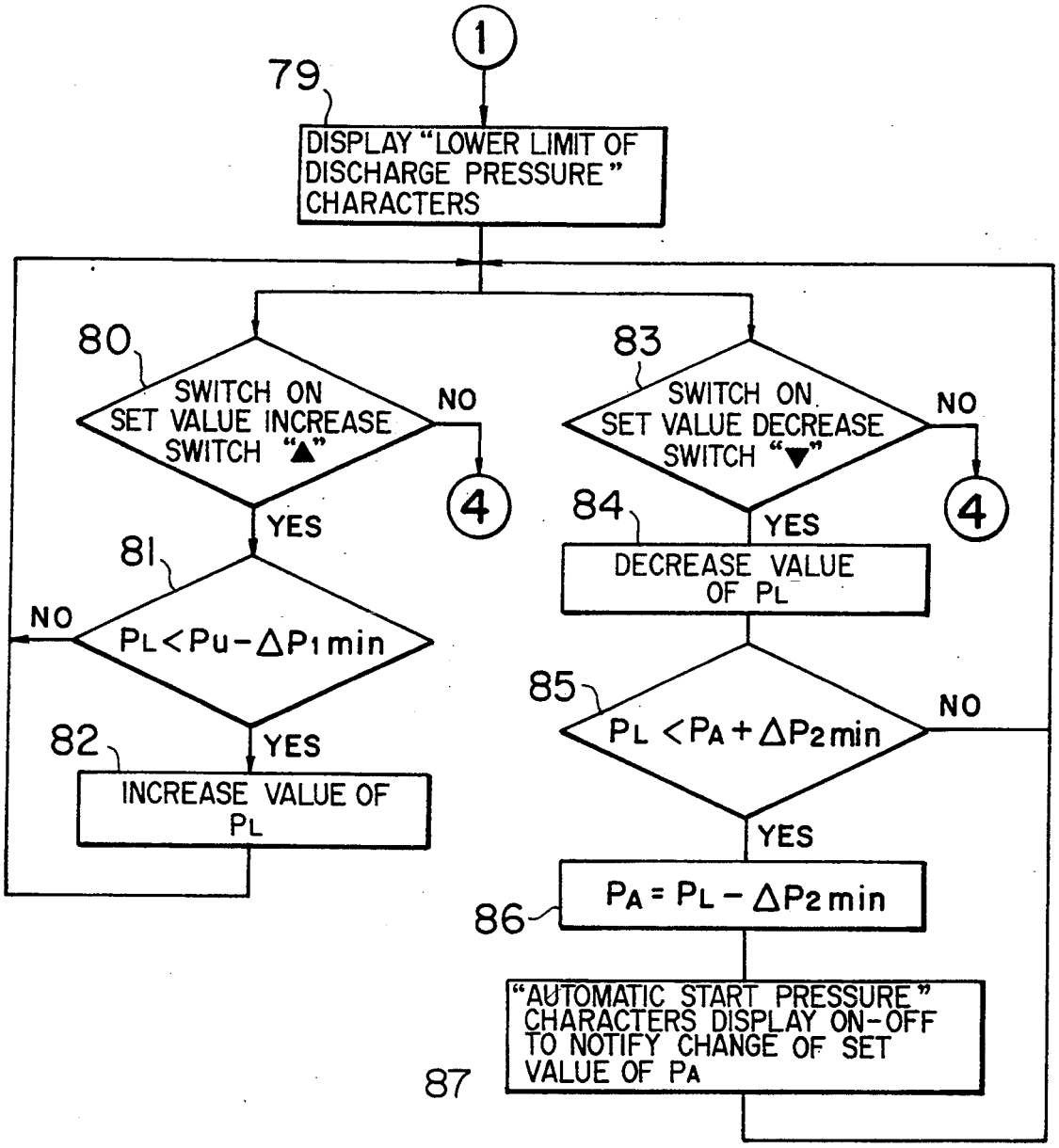
Figure 13D:
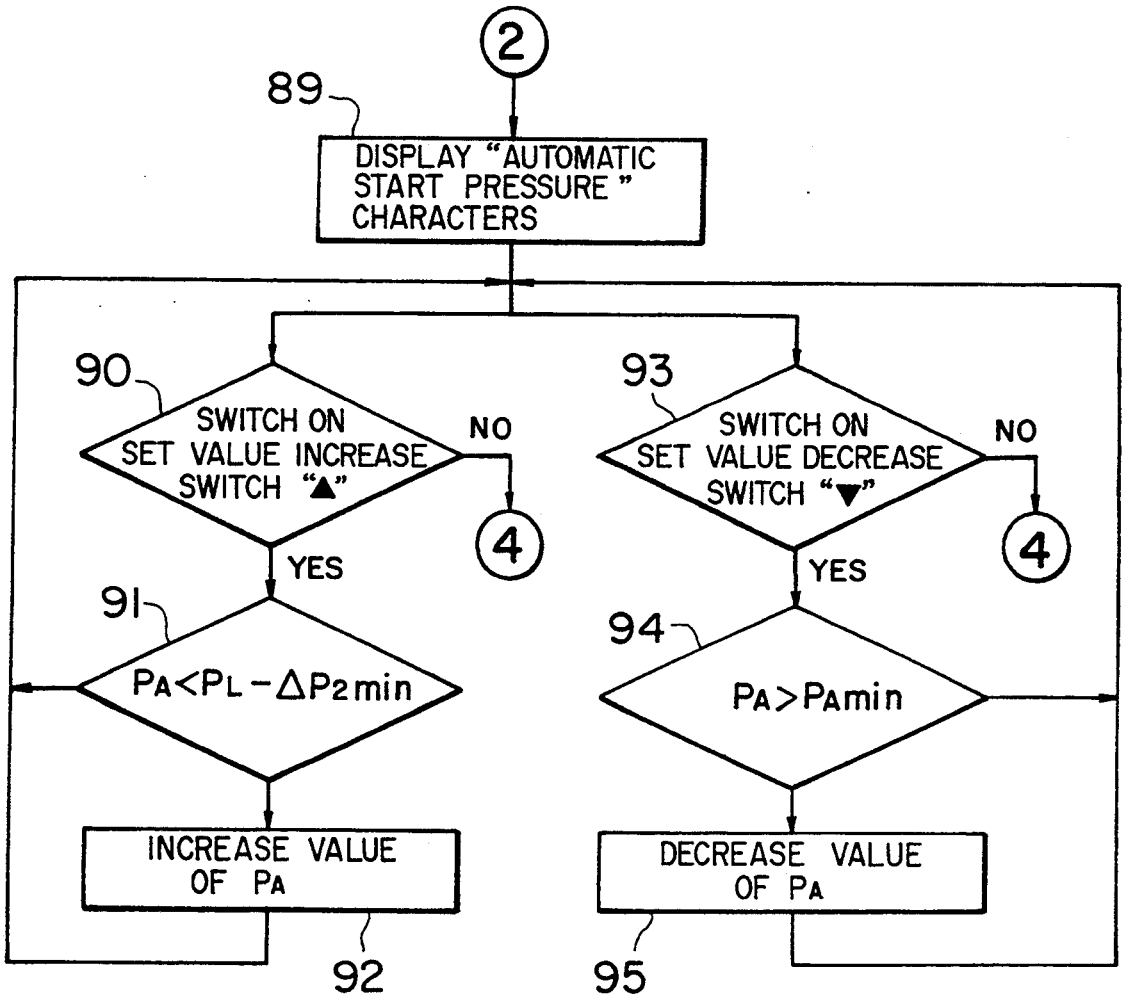

As shown in FIG. 13, assumptions are made that the limit pressure for the compressor is $P_{max}$, the upper limit of the discharge pressure is PU, the lower limit of the discharge pressure is $P_L$, the automatic starting pressure for the compressor is $P_A$ the minimum level of the automatic starting pressure is $PA_{min}$ and the specification or operation pressure is P.

The compressor 55 is basically automatically operated in the following ways (i) to (iv):

(i) When the discharge pressure P has been raise to $P_U$, the compressors 1 and 2 are operated under no load (unload operation).

(ii) When the discharge pressure P has been lowered to PL, the compressor 1 and 2 are operated under load to discharge air (on-load operation).

(iii) The foregoing steps (i) and (ii) are repeated.

(iv) When the line pressure has been lowered to a level, not higher than $P_A$, during the stop of the compressors 1 and 2, the compressors 1 and 2 are automatically started.

The foregoing setting and control are performed under the following conditions:

(a) It is used to control unload and on-load operation of the compressors 1 and 2.

(b) The following relationships must be held: $P_U > P_L > P_A$ and $P_{max} \geqq P_U$. (This is because, if $P_U$ and $P_L$ are inverted ($P_L \geqq P_U$), the compressors 1 and 2 cannot be controlled. If $P_A > P_L$, the automatic start signal is always undesirably transmitted during the operations of the compressors 1 and 2, causing a trouble of the units to take place.

(c) If $\Delta P_1 = P_U - P_L$ is too small, hunting phenomenon in which the on-load and unload operations are repeated in a short period occurs, causing the capacity control units to be damaged. Therefore, $\Delta P_{1min}$ is so determined that the relationship $\Delta P_1 \geqq \Delta P_{1min}$ is held.

(d) As for $\Delta P_2 = P_L - P_A$, $\Delta P_{2min}$ is determined while considering the detection error of the pressure detection devices (not shown) and the pressure change to hold the relationship $\Delta P_2 \geqq \Delta P_{2min}$.

The foregoing setting and control are performed as shown by flow charts of FIGS. 13A to 13D.

Figure 14:
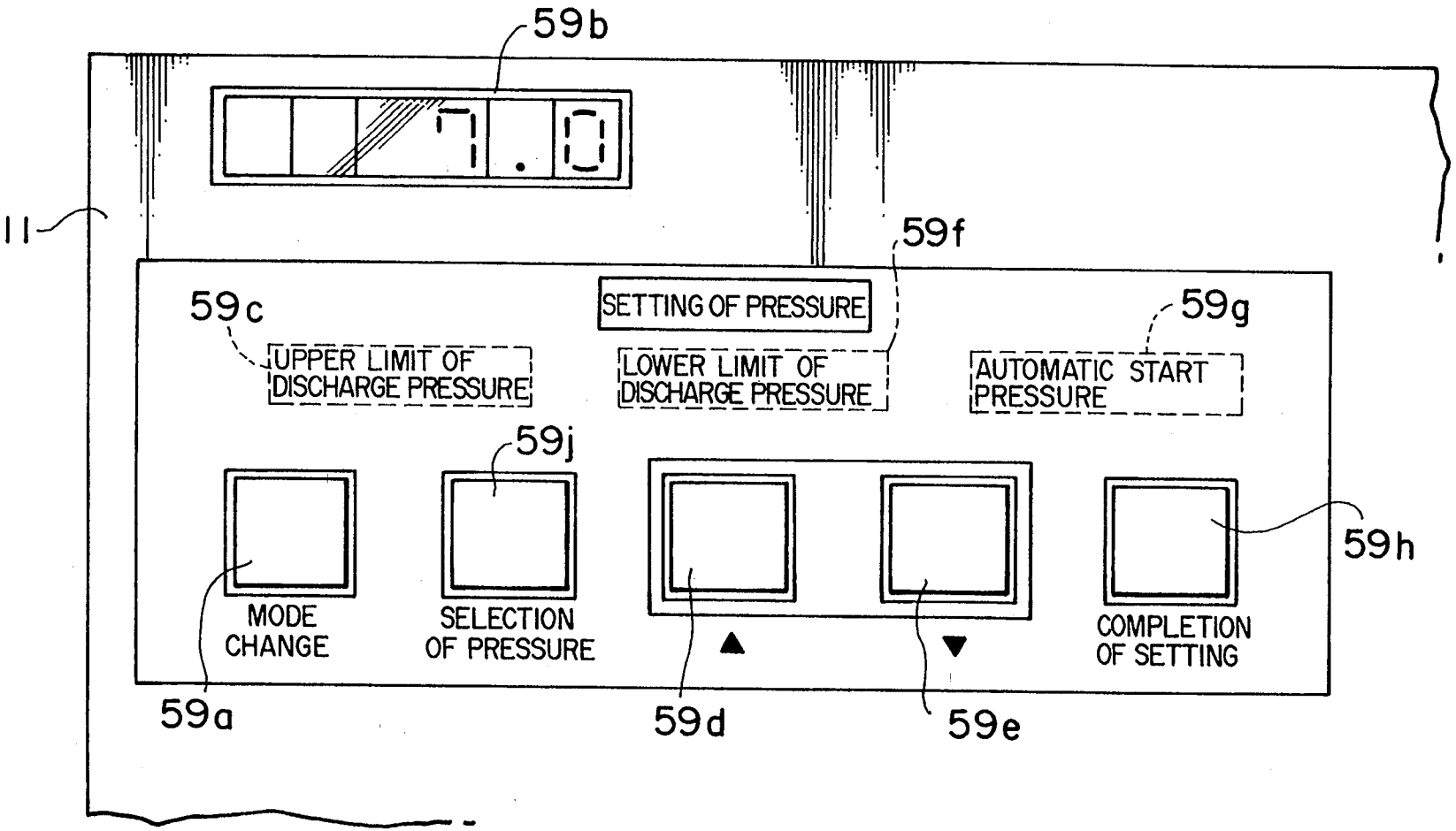
FIG. 14 is an explanatory view which illustrates switches and indicators disposed on a control panel for performing the control shown in FIGS. 13A to 13D.
Figure 15:
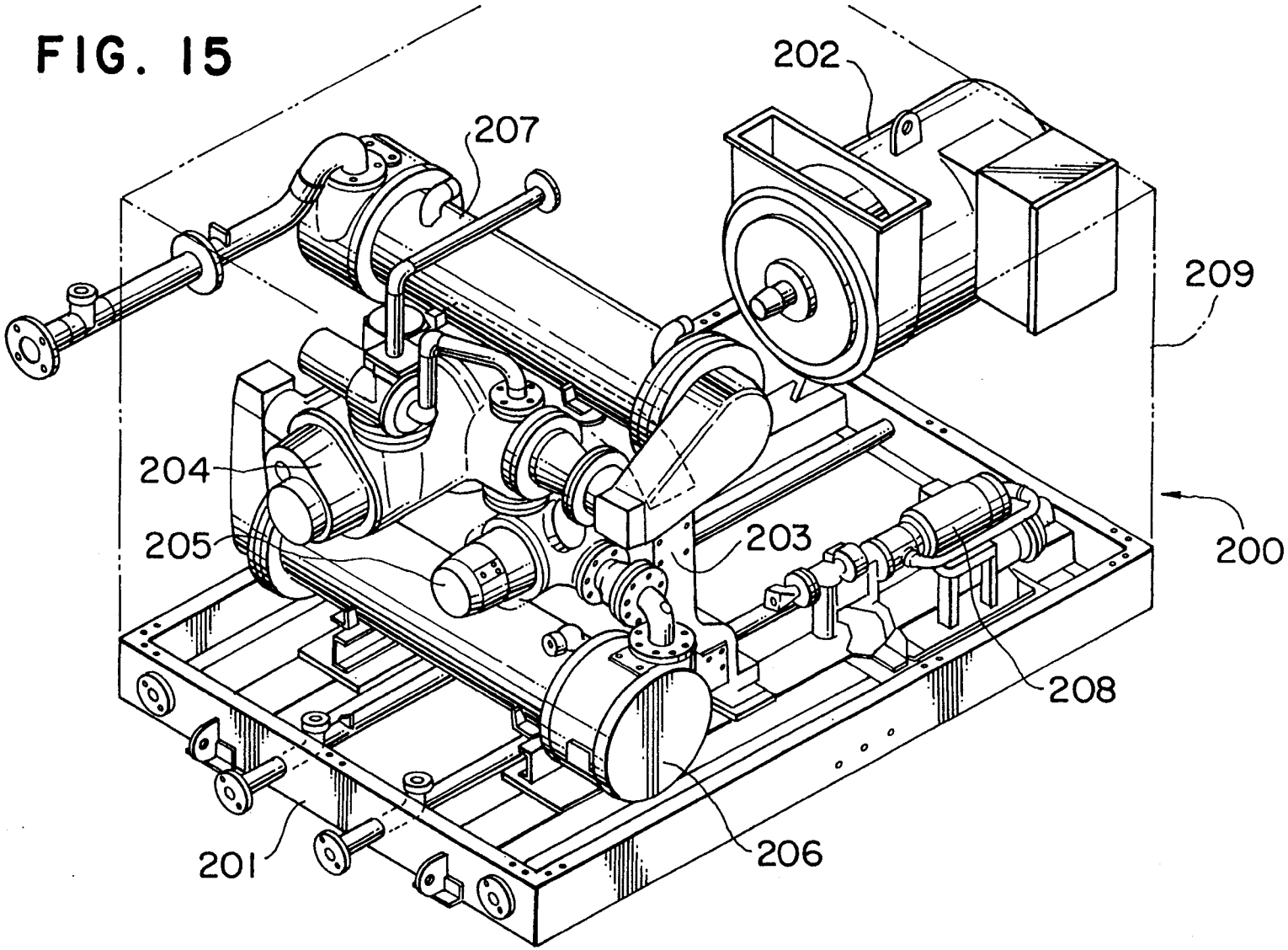
FIG. 15 is a perspective view which illustrates an arrangement of internal units in a conventional package-type screw compressor.

First, a mode change switch **59*a* of the related switches on the control panel 11 shown in FIG. 14 is depressed in a step 60** so that a pressure setting mode is selected.

Then, a pressure selection switch **59*j* is depressed to select a mode for setting the upper limit of discharge pressure, and then the flow is shifted to step 61 in which the present upper limit value $P_U$ is displayed on a digital numerical value display or indicator 59*b*. In next step 62, a LED (Light-Emitting Diodes) 59*c* showing the upper limit of the discharge pressure is turned on. If the set upper limit $P_U$ is raised, a set-value increment switch 59*d* is depressed to shift the flow from a step 63 to a step 64. In a case where the upper limit value $P_U < P_{max}$, the value of $P_U$ is increased in a step 65 and the value displayed on the display 59*b* is also changed. If $P_U < P_{max}$, the steps 63 to 65** are repeated and the upper limit value $P_U$ is increased. On the other hand, setting of $P_U$ holding the relationship $P_U \geqq P_{max}$ is not allowed because the foregoing condition (b) is not met. Therefore, the flow returns. At this time, alarm or the like may be issued.

If the set upper limit $P_U$ is lowered, a set-value decreasing switch **59*e* is depressed so that the flow proceeds from a step 66 to a step 67. In the step 67, the value of $P_U$ is decreased and the value displayed on the display 59*b* is also changed. In next step 68, $\Delta P_1 = P_U - P_L$ is subjected to a comparison with $\Delta P_{1min}$. If $\Delta P_1 \geqq \Delta P_{1min}$, the steps 66 and 67 are repeated and the upper limit value $P_U$ is decreased. On the other hand, if it is determined at the step 68 that $\Delta P_1 < \Delta P_{1min}$ the lower limit value PL is so changed at a step 69 that the relationship $\Delta P_1 = \Delta P_{1min}$ is held. In step 70, the characters-LED 59*f* "LOWER LIMIT OF DISCHARGE PRESSURE" is turned on and off (flickers) to notify the change of the lower limit value $P_L$. In a step 71, $\Delta P_2 = P_L - P_A$ after $P_L$ has been changed as described above is subjected to a comparison with $\Delta P_{2min}$. If $\Delta P_2 \geqq \Delta P_{2min}$, the steps 66 to 71 are repeated so that the upper limit value $P_U$ and the lower limit value $P_L$ are decreased. If a discrimination is made that $\Delta P_2 < \Delta P_{2min}$, the automatic starting pressure $P_A$ is so changed in a step 72 that the relationship $\Delta P_2 = \Delta P_{2min}$ is held. In a step 73, the characters LED 59*g* "AUTOMATIC STARTING PRESSURE" is turned on and off (flickers) to notify the change of the automatic starting pressure $P_A$. If the upper limit value $P_A$ is further decreased, the steps 67 to 73** are repeated.

If a confirmation is made that the upper limit value $P_U$ can be made to be a predetermined value by the increase or the decrease of the upper limit value $P_U$, a setting-completion switch **59*h* is depressed to cause the flow to pass step 63 or 66 through a step 74 to a step 75 in which blinking or flickering of the characters display 59*c* "UPPER LIMIT OF DISCHARGE PRESSURE" is stopped. In a step 76, values $P_U$, $P_L$ and $P_A$ determined in the foregoing steps are adopted as updated set values, and the process of the pressure setting mode is completed in the step 77**.

When the pressure setting mode has been selected by depressing the mode change switch **59*a* and the lower limit PL of the discharge pressure is selected by depressing the pressure selection switch 59*j*, the flow proceeds to a step 78 in which the present value of the lower limit $P_L$ is displayed on the display 59*b*. In next step 79, the LED 59*f*** indicating the lower limit of the discharge pressure is turned on.

If the lower limit value $P_L$ is raised, the increase switch **59*d* is depressed to make the flow proceed from a step 80 to a step 81. A comparison is made between $\Delta P_1 = P_U - P_L$ and $\Delta P_{1min}$. If $\Delta P_1 > \Delta P_{1min}$, $P_L$ is increased in a step 82 and the steps 80 to 82** are repeated so that the lower limit value $P_L$ is increased. If a discrimination is made that $\Delta P_1 \leqq \Delta P_{1min}$, the condition (c) is not met. Therefore, the increase in $P_L$ is not allowed and the flow returns. An alarm or the like may be issued at this time.

If the lower limit value PL is decreased, the decreasing switch **59*e* is depressed to make the flow proceed from a step 83 to a step 84 in which the value of PL is decreased. In steps 85 to 87 which are similar to steps 71 to 73**, $P_L$ is decreased to a predetermined value and $P_A$ is, if necessary, decreased.

If confirmation has been made in the steps 80 to 87 that the lower limit value $P_L$ can be increased or decreased to the predetermined value, the setting-completion switch **59*h* is depressed similarly to the foregoing case so that the flow is shifted from the step 80 or step 83 to the steps 74 to 76 so that the determined values $P_L$ and $P_A$ are adopted as the updated set value. Then, the process of the pressure setting mode is completed in the step 77**.

Similarly, when the mode switch **59*a* has been used to select the pressure setting mode and the pressure selection switch 59*j* has been used to select the mode for setting the automatic starting pressure $P_A$, the flow proceeds to a step 88 in which the present value of the automatic starting pressure $P_A$ is displayed on the display 59*b*. In next step 89, the LED 59*h*** indicating the automatic starting pressure is turned on.

When the automatic starting pressure PA is raised, the increasing switch **59*d* is depressed to cause the flow proceed from a step 90 to a step 91. In the step 91, $\Delta P_2 = P_L - P_A$ is subjected to a comparison with $\Delta P_{2min}$. If $\Delta P_2 > P_{2min}$, $P_A$ is increased in a step 92 and the steps 90 to 92 are repeated so that the automatic starting pressure PA is raised. If a discrimination has been made in the step 91** that $\Delta P_2 \leqq \Delta P_{2min}$, the condition (d) is not met. Therefore, the increase of $P_A$ is not allowed and the flow returns. At this time, an alarm or the like may be issued.

When the automatic starting pressure $P_A$ is lowered, the decreasing switch **59*e* is depressed to cause the flow proceed from a step 93 to a step 94. If the pressure is higher than the lowest automatic starting pressure $P_{Amin}$, the decreasing of $P_A$ at a step 95 is repeated in the repeated steps 93 to 95**.

When $P_A$ has been made to be the predetermined value, the completion switch 59*h* is depressed so that the automatic starting pressure $P_A$ is set to an updated value in the steps 74 to 77.

The pressure setting system shown in FIGS. 13, 13A to 13D and 14 ensures to avoid a problem taken place due to an erroneous setting and to avoid the erroneous setting per se.

The foregoing control is performed by a controller 97 shown in FIG. 3 and comprising a microprocessor including programs according to the flow charts shown in FIGS. 13A to 13D.

Figure 6:
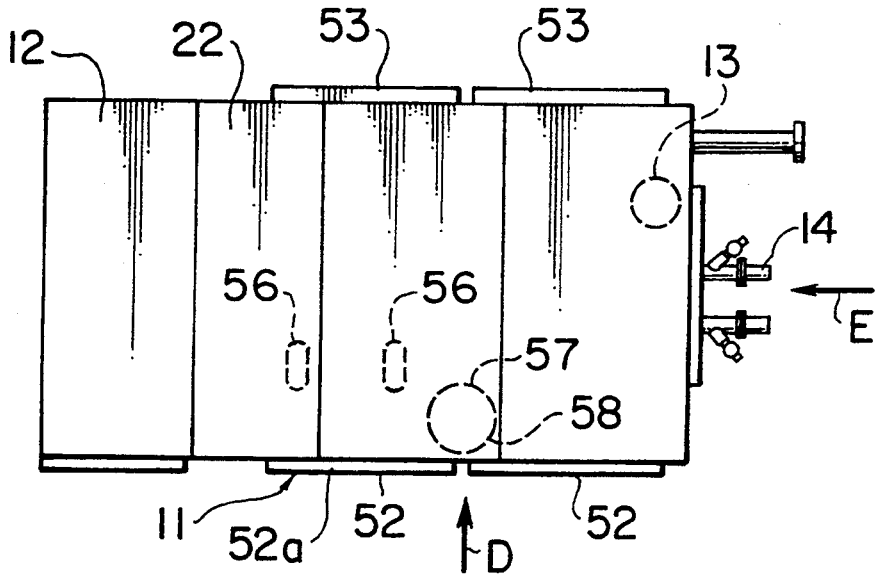
FIG. 6 is a plan view which illustrates portions of the compressor shown in FIG. 1 to be inspected daily.

FIG. 6 is a plan view which illustrates portions of the package to be inspected daily or usually. Near the front panels 52, to which the control panel 11 is mounted, a grease supply ports 56, a lubricating-oil level meter 57 and an oil supply port 58 are provided. Further, near the adjacent side panel 54, the oil filter 13 and the air cooler drain discharge ports 14 are provided. The front panel 52 and the side panel 54 are made to be sides or directions D and E in which the daily inspection is performed. Thus, the operator need not move around the compressor 55 for the daily inspection. Further a space required to install the package 50 can be reduced and, or the space required to install the compressor apparatus 55 and a maintenance space can be reduced.

Figure 7:
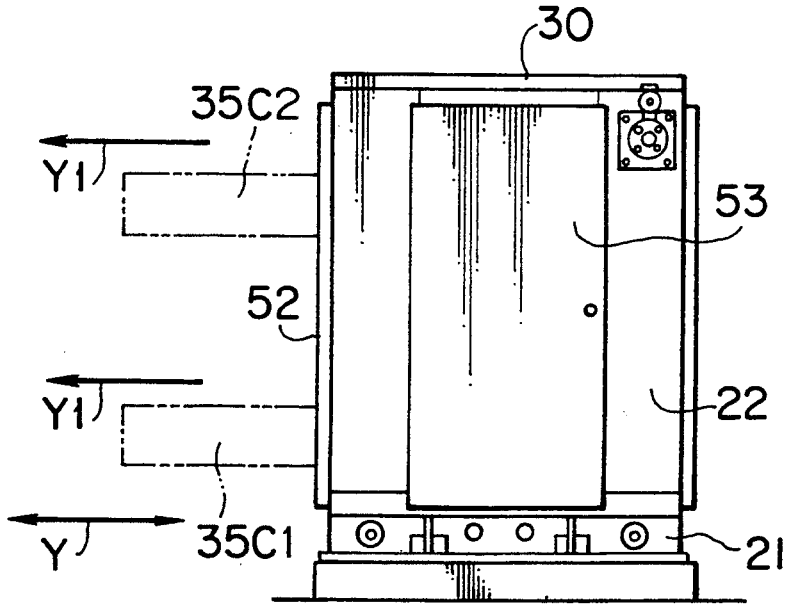
FIG. 7 is a side elevational view which illustrates a direction in which an air cooler tube nest of the compressor shown in FIG. 1 is drawn out.

FIG. 7 illustrates the direction Y1 in which the tube nest of the intercooler 5 and that of the aftercooler 6 are removed or drawn out. After opening the front panel 52, the intercooler 5 and the aftercooler 6 can be removed through the opened front panel 52 in the direction Y1.

Figure 8:
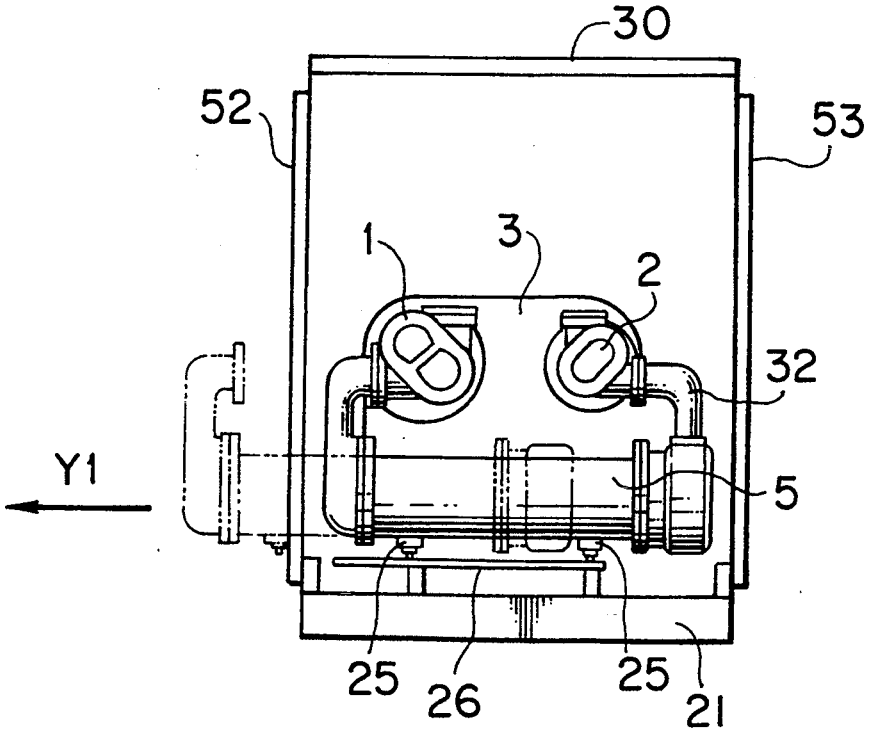
FIG. 8 is a side elevational view for illustrating a way of slidingly drawing out an intercooler of the compressor shown in FIG. 1.

FIG. 8 is a side elevational view which illustrates a way of removing the intercooler 5 by slidingly drawing it out. After opening the front panel 52 and the side panel 54 for example, the high-pressure-stage suction pipe 32 is detached and removed. By loosening the nut 27*b* shown in FIG. 4A, the foregoing fixing bracket 27 is lowered. When the casters 25 are then placed on the rails 26, the intercooler 5 can be moved in the direction Y1 shown in FIG. 8. Since the overall body of the intercooler 5 can easily be taken out to the outside of the package 50, the cleaning work can easily be performed.

Figure 9:
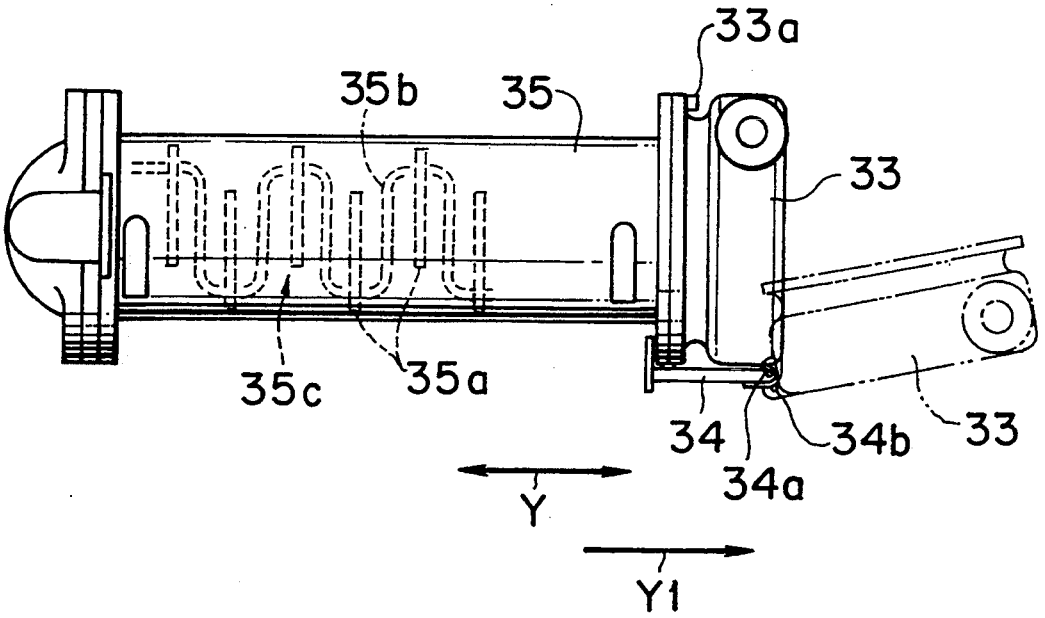
FIG. 9 is a plan view which illustrates states where an end-surface cover of the air cooler of the compressor shown in FIG. 1 is opened/closed.

FIG. 9 is a plan view which illustrates a state where an end cover 33 of the air cooler (the intercooler 5 and the aftercooler 6) is opened/closed. FIG. 9 illustrates an example arranged so that the end cover 33 at a side of an air outlet also serving as a mist separator of the cooler 5 or 6 can be opened and closed. Although the end cover 33 is usually fixed to a flange of a cooler shell 35 by a bolt 33*a*, the fastening bolt 33*a* is removed at the time of the maintenance and inspection work so as to allow the end cover 33 to be rotatively moved around a hinge pin 34*a* of a hinge bracket 34 provided for the cooler shell 35. Therefore, the cleaning and inspection works can easily be performed. This embodiment is so arranged that the space required to open/close the end cover 33 is minimized by disposing the rotation center of the hinge bracket 34 at a leading edge position of the end cover 33. Since a hinge-pin insertion hole 33*b* of the hinge bracket 34 or the end cover 33 is formed into an elongated hole, the hinge pin 34*a* can be slightly shifted in the longitudinal direction Y1 at the time of opening the end cover 33. Therefore, the "O" ring and packings can be protected from damage at the time of the opening and closing operations.

Figure 10:
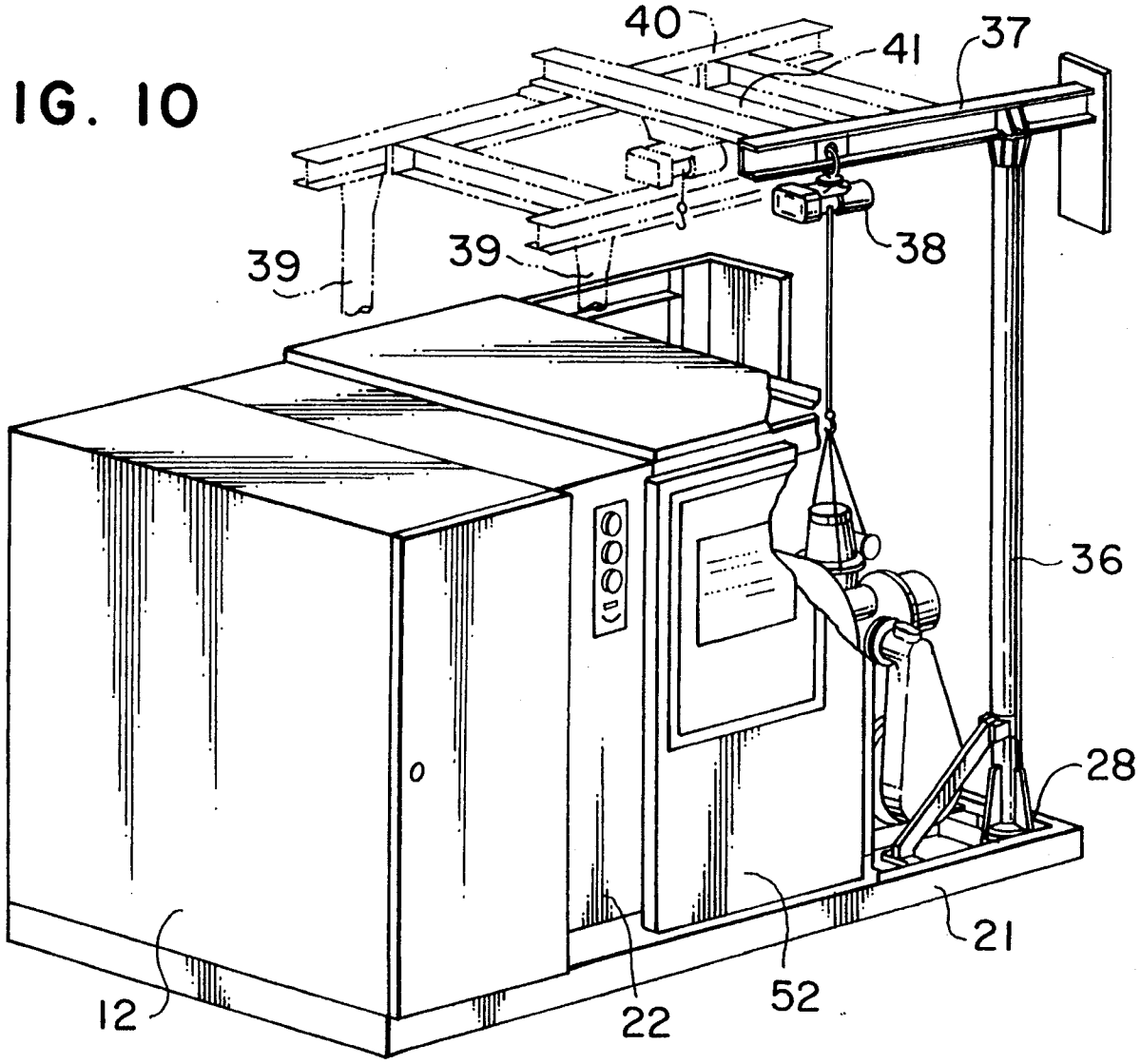
FIG. 10 illustrates a state where a maintenance and inspection crane of the compressor shown in FIG. 1 is installed.

FIG. 10 illustrates a state where maintenance and inspection crane is installed. When the auxiliary devices are inspected, the front panels 52, the side panels 54, and a pair of the outer peripheral frame 51 and the like are detached and removed. Then, a pole crane support column 36 is mounted on a seat 28 positioned at a corner formed by the front panel 52 (or its extension) and the side panel 53 (or its extension). A rotative arm 37 is mounted on the column 36 so that the units or devices can be hoisted by a hoist 38. The noise insulating cover 22 and its frame 51 at a side of the side panel 54 can be detached so that the units or devices can be taken out in the same (opened) direction. The pole cranes 36, 37 and 38 may be accommodated in the box member 50. When the overall body of the package 50 is maintained and inspected, the frame 51, the panels 22, 52, 53 and 54 constituting the box member 50 are removed. Then, three additional columns 39 (one of them is omitted from illustration) shown by imaginary lines are, as well as the column 36, mounted on the four seats 28 (three seats not shown) on the base 21. Further, beams 40 and a movable girder 41 are disposed so that the work for hoisting the units in the package 50 is performed.

Figure 11:
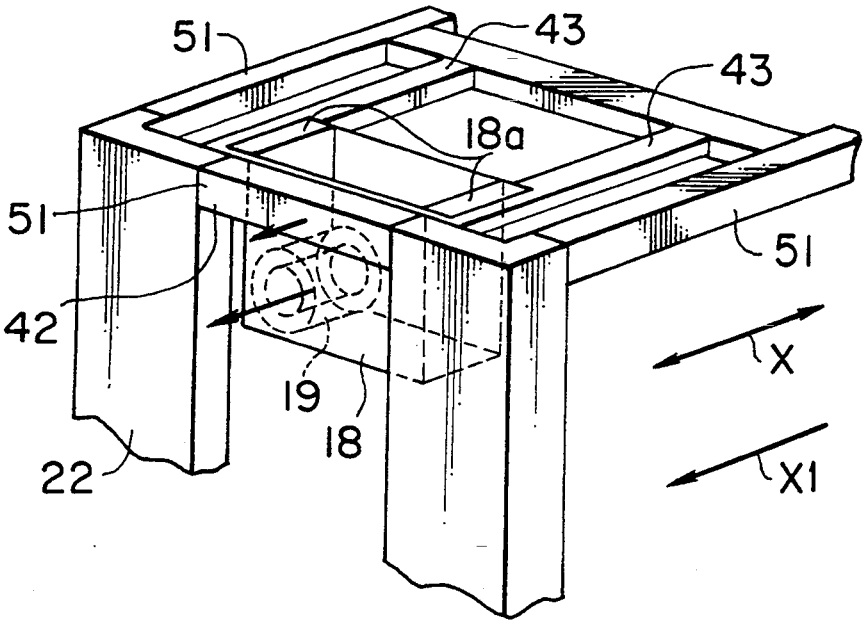
FIG. 11 is a perspective view which illustrates a way of drawing out a suction duct of the compressor shown in FIG. 1.

FIG. 11 illustrates a way of removing or drawing out the suction duct 18. Flanges 18*a* and 18*a* are disposed above the suction duct 18 so that the suction duct 18 is suspended from two beams 43 extending perpendicularly to the side panel 54. When the maintenance and the inspection works are performed, the ceiling panel 30 and the side panel 54 are opened or removed. Then, a frame 42, disposed above the side panel 54, among the outer peripheral frame 51 is first removed, and the suction duct 18 is drawn out toward the surface of the side panel 54 to remove the suction duct 18. Since the suction duct 18 is slid at the flange portions 18*a* on the beams 43, it can easily be removed in the direction X1. After the suction duct 18 has been removed, the central portion above the side panel is opened so that the units in the package 50 can easily be taken out by hoisting the units.

Figure 12A:
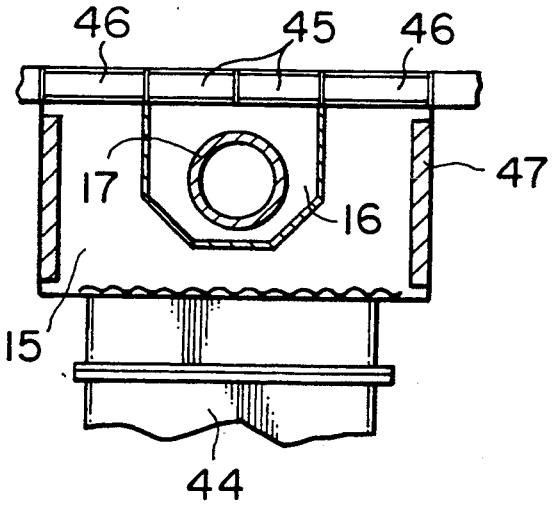
FIGS. 12A and 12B are, respectively, side sectional view and partially broken rear view of a structure of combination of an air discharge duct and a motor-air discharge duct of the compressor shown in FIG. 1.
Figure 12B:
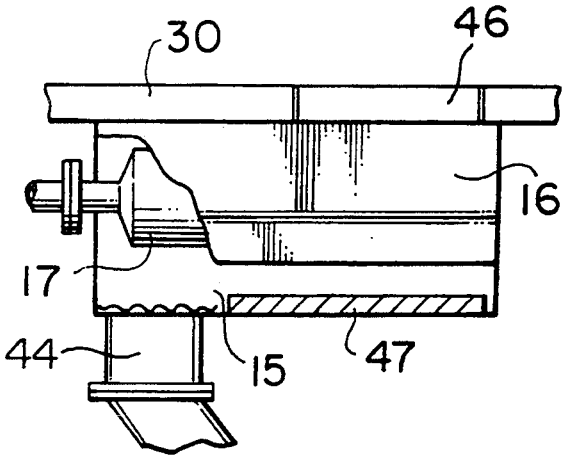

FIGS. 12A and 12B illustrate the air-discharge duct 16 upon the unload operation and the motor-air discharge duct 15. The air-discharge duct 16 accommodating therein the air-discharge silencer 17 is formed in the motor-air discharge duct 15 to be separated from a passage through which air discharged from the motor 4 passes. Air discharged from the compressors 1 and 2 under the unload operation is discharged through the air-discharge silencer 17, and then the discharged air is flown to the outside of the package 50 through the air-discharge louver 45 of the ceiling panel 30. Air, which has cooled the motor 4, and discharged from the motor 4 through the motor-air discharge port 44 passes through the motor-air discharge duct 15. Then, the air is discharged to the outside of the package 50 through the motor-air discharge louver 46. The motor-air discharge duct 15 has a noise absorber 47 applied to the inner wall thereof to insulate noise. Since the air discharged from the motor 4 flows around the air-discharge duct 16 before it is discharged to the outside, noise transmission and heat radiation from the air-discharge duct 16 into the package 50 can be minimized. Since the air-discharge louver 45 and the motor-air discharge louver 46 are dispose adjacently, hot discharged air discharged from the package 50 joins together with the air discharged from the motor 4 to be cooled thereby.

According to the present invention, the daily or usual inspection work can easily be performed and the time taken to complete the inspection work can be shortened. Further, the space required to perform the inspection work can be reduced so that the limitation present upon the installation such as the installation space and the installing direction can be minimized. Therefore, the installation design can relatively freely be performed.

Moreover, the maintenance and inspection work can easily be performed so that the maintenance cost is reduced.

Further, the maintenance space can be reduced so that installation is relatively freely performed.

Since the overall body of the cooler can easily be removed, the time taken to perform the maintenance work can be shortened. Therefore, the maintenance cost can be reduced.

Since the end cover of the air cooler can easily be opened or closed, the work for maintaining and inspecting the air cooler can easily be performed. Therefore, the maintenance cost can be reduced.

The maintenance space for the coolant cooler and the oil cooler and the like can be commonly used with the maintenance space for the air cooler. Therefore, the space required to install the compressor can be reduced.

Since the suction duct can easily be removed, the work for maintaining various units can easily be performed at the time of the maintenance and inspection work. Therefore, the maintenance cost can be reduced.

Since equipment such as the ceiling-mounted crane can be omitted, the cost required to install the compressor can be reduced.

Since hot discharged air does not flow into the motor, the reliability can be improved.

Since the space in the package can effectively be used, the size of the package can be reduced and the maintenance work can easily be performed.

A preferred embodiment mainly composed of rotor portions of the low and/or high-pressure-stage compressor bodies 1 and 2 will now be described with reference to FIGS. 16 to 18, 20 and 21.

Figure 16:
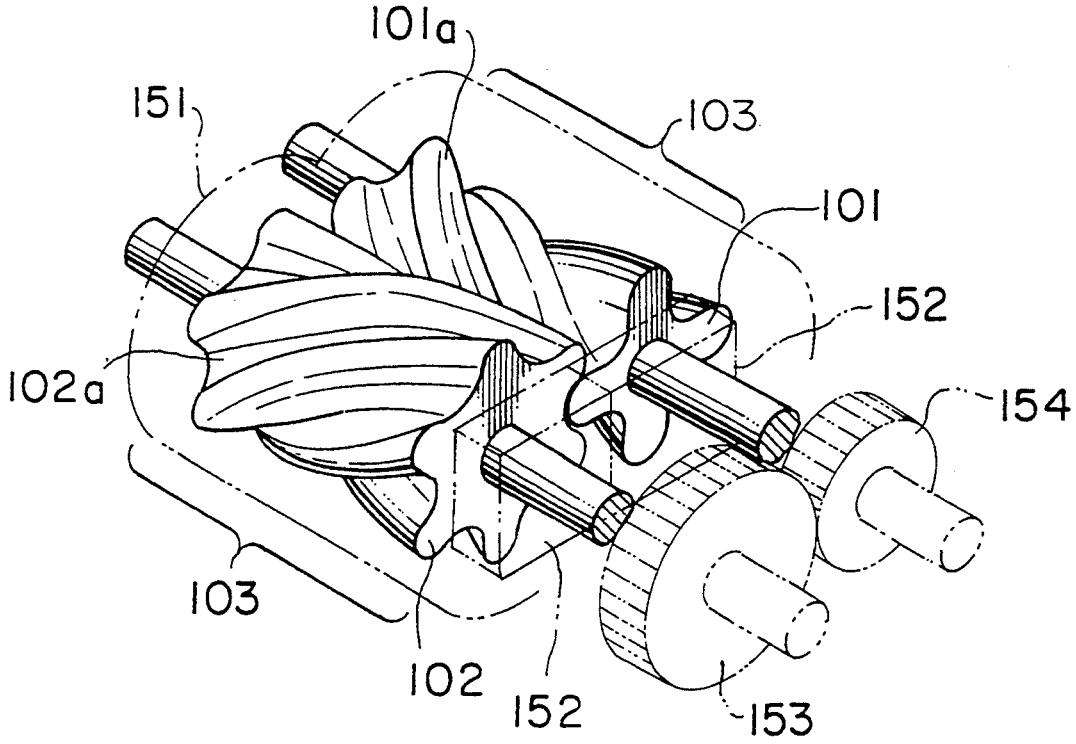
FIG. 16 is a perspective view which illustrates mating engagement between a male rotor and a female rotor of the screw compressor.
Figure 17:
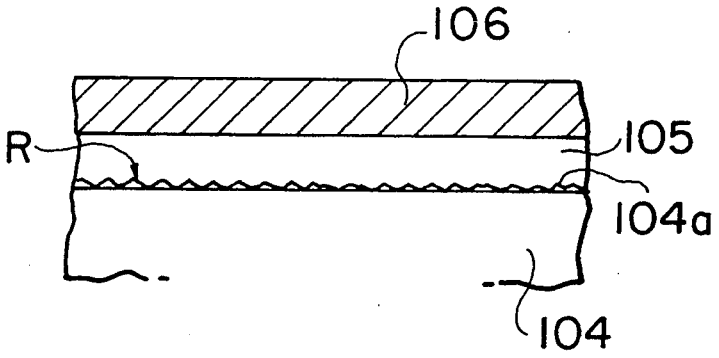
FIG. 17 is an enlarged view which illustrates coating layers according to an embodiment of the present invention, wherein an essential portion of the relationship between the base of the screw rotor and the coating layers is illustrated in an enlarged and cross sectional manner.

As shown in FIG. 16, a male rotor 101 having spiral and projecting teeth 101*a* and a female rotor 102 having spiral and concave teeth 102*a* are so supported by bearings 152, 152 (bearings at the other sides not shown) disposed in the casing 151 that the rotors 101 and 102 are rotated in a non-contact manner in the casing 151 but the teeth 101*a* and 102*a* of the rotors 101 and 102 are substantially matingly engaged with each other. The two rotors 101 and 102 are connected to each other by means of synchronizing gears 153 and 154.

A lobe 103 of the male rotor 101 and that of the female rotor 102 shown in FIG. 16 are heated to the same temperature at which a PFA coating material is baked to degrease the lobes 103. Then, the surface of a base 104 of the rotor made of material such as carbon steel is roughened as designated by the reference symbol R in FIG. 17 which shows a part of the base portion of the rotor. The roughed surface 104*a* is applied with a primer coating 105, and then it is dried. Then, a PFA coating material 106 is applied to the surface of the dried primer coating 105, and then the whole body is subjected to baking.

As disclosed in "LATEST FLUOROPOLYMER COATING TECHNOLOGY", (published by Epote Co., Ltd.) p.p 8 and p.p 304, the PFA has the following structure:

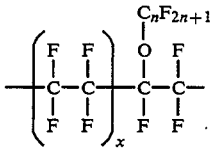

where x and n are positive integers. For example, material having trade name corresponding to Teflon PFA (trade name) of DuPont is available from Mitsui DuPont Prolochemical.

Figure 18:
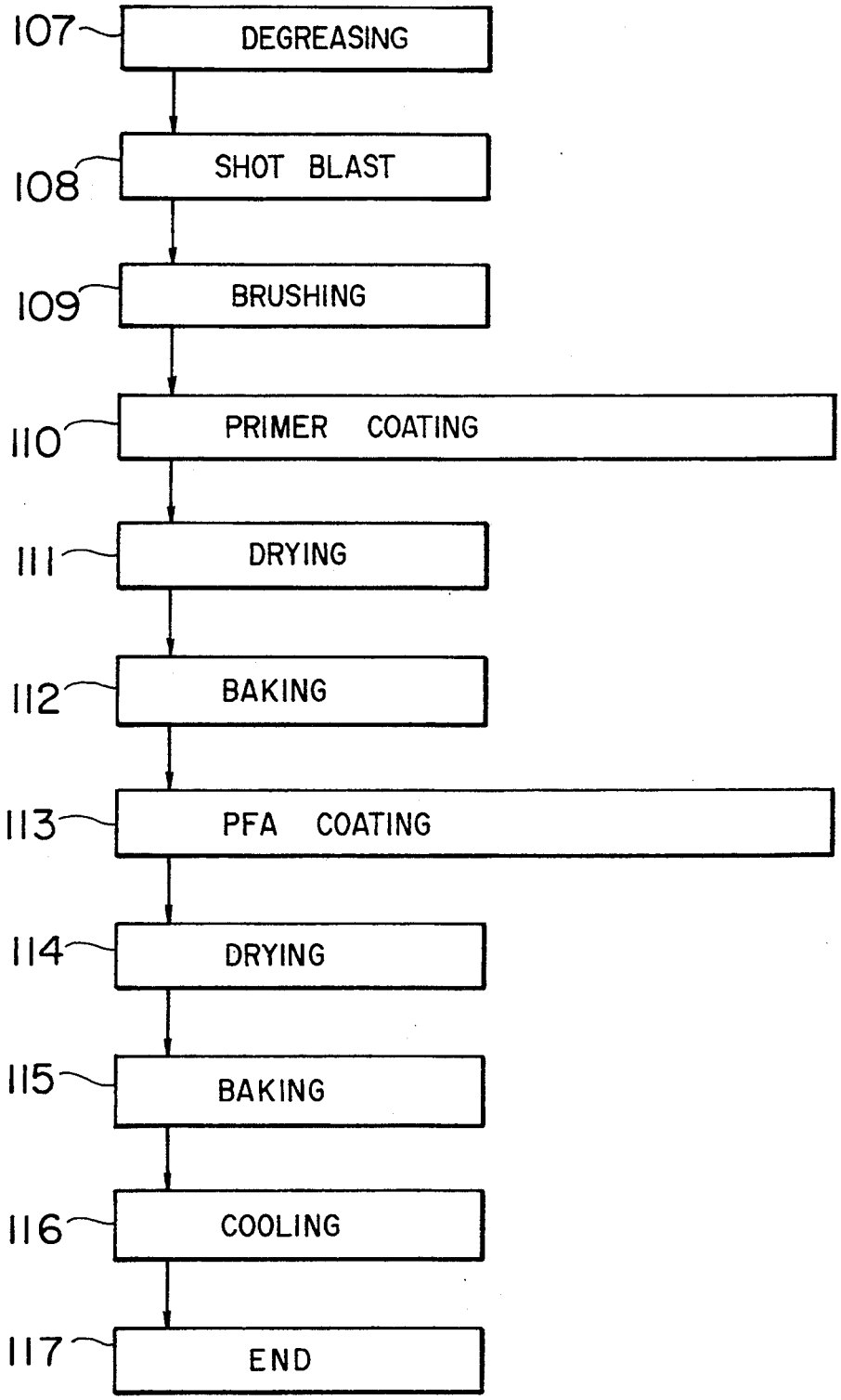
FIG. 18 illustrates a process flow for performing PFA coating according to an embodiment of the present invention.

The process for the PFA coating is shown in detail in FIG. 18. First, the base 104 (see FIGS. 16 and 17) of each lobe 103 of the screw rotors of each of the dry screw compressors 1 and 2 is machined to have a predetermined shape. Then, the base 104 of the lobe 103 is heated at the temperature, which is the same as that at which the PFA coating is baked, to degrease 107. Then, the base 104 is cooled to the temperature of the treatment room, and then the coating surface of the base 104 of the lobe 103 is roughened by performing alumina shot blasting 108. Then, the roughened surface 104*a* is cleaned by brushing 109, and then coating 110 of a primer coating composition composed of materials such as PFA particles, pigment and binder is performed. Then, the primer coating film is dried (step 111), and then it is preliminarily baked (step 112) at 300° C. to 350° C., and then it is cooled. Then, coating 113 of the PFA film is performed. Then, a confirmation is made that the PFA film has been dried (step 114), and then it is baked (step 115) at 390° C. to 420° C. Then, it is cooled (step 116), and then the thickness of the PFA film 106 is measured. If a predetermined thickness is not achieved, the steps 113 to 116 shown in FIG. 18 are repeated to have a required thickness.

Figure 21:
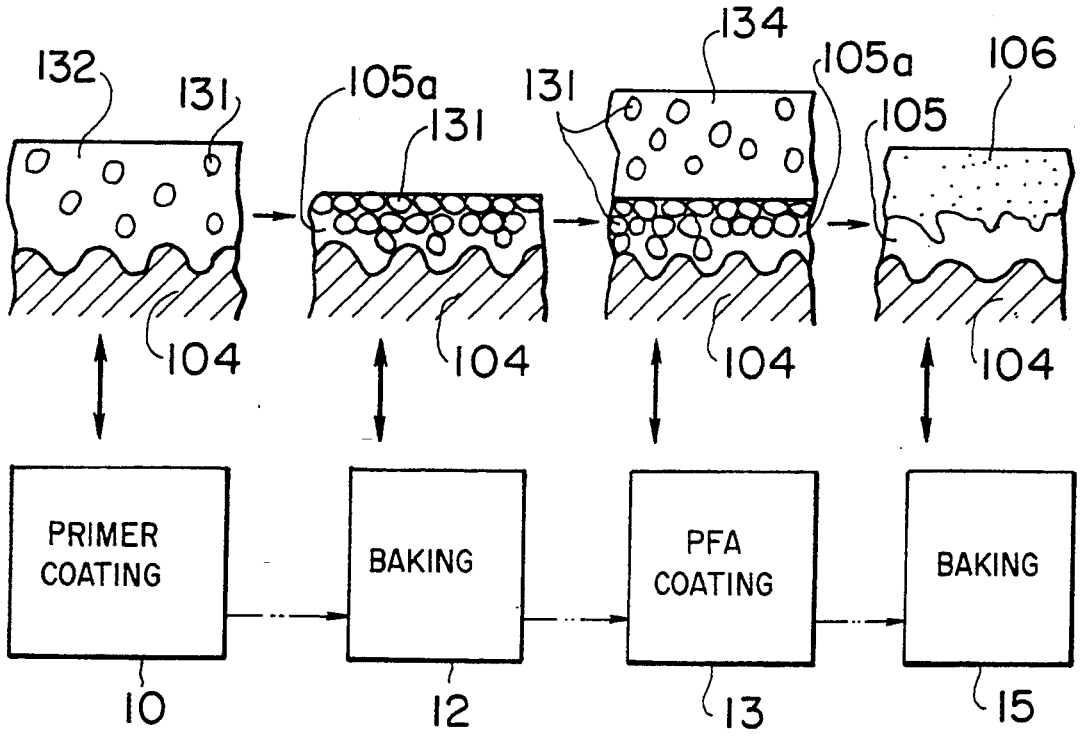
FIG. 21 illustrates a process of formation of the PFA coating film.

FIG. 21 shows a process of forming the PFA coating film. In this process, a primer coating solution 132, in which the PFA particles 131, the binder, the pigment and water are mixed and dispersed, is applied on to the roughened surface 104*a* of the rotor base 104 in the foregoing primer coating step 110. After drying 111 and the preliminary baking 112 is performed, a solution 34 of the PFA particles 131 is applied to the preliminarily-baked primer film 105*a* in step 113 and is then dried. In the next Step 115, the overall body is baked so that the PFA particles 31 on the rotor base 104 are melted to have a continuous coating film 105, 106. The change of the states of the film at the time of the PFA coating, per se, has been disclosed in the above-mentioned "LATEST FLUOROPOLYMER COATING TECHNOLOGY", p.p 104.

Then, PFA coating according to the present invention is compared with conventional PTFE coating.

Figure 22:
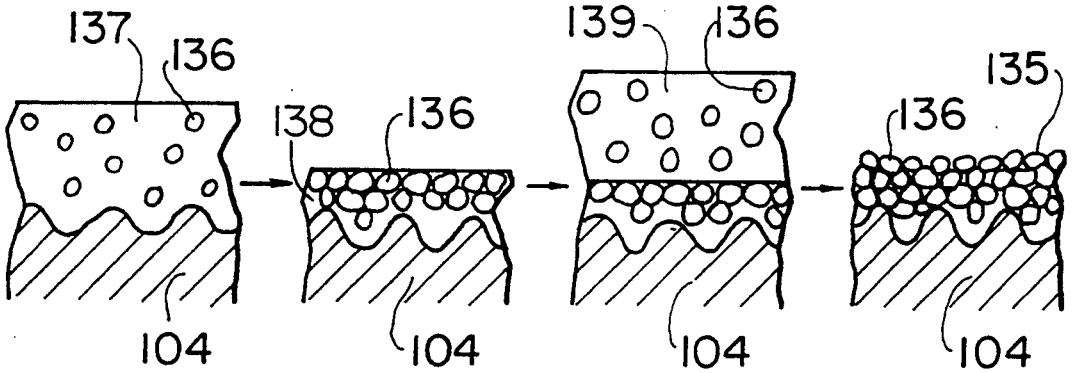
FIG. 22 PRIOR ART
FIG. 22 illustrates a process of formation of a conventional PTFE coating film.

Although the steps of the conventional process for forming the PTFE coating film proceeds similarly as shown in FIG. 22, PTFE particles 136 applied to the surface of the rotor base 104 are not melted but stacked while maintaining their particle shapes to form a PTFE film 135. Reference numeral 137 represents a PTFE primer coating solution, 138 represents a PTFE primer coating layer which has been preliminarily or temporarily baked, and 139 represents a main PTFE-coating solution. The state of the PTFE film has been also disclosed in the above-mentioned "LATEST FLUOROPOLYMER COATING TECHNOLOGY", p.p 104.

Although the corrosion resistance of the PTFE particles 136 is similar to that of the PFA particles 131, the fact that the PTFE coating film is formed by a simple aggregation of the PTFE particles 136 allows pin holes to be easily formed along regions at which the particles 136 and 136 are joined together. Therefore, a, thickness of the PTFE coating film 135 must be thicker as compared with the PFA film 106 in order to have satisfactory corrosion resistance. In other words, the PFA film 106 has satisfactory corrosion resistance even if its thickness is relatively thin.

Then, a comparison between the PFA coating according to the present invention and conventional $MoS_2$ coating will be made.

Figure 19:
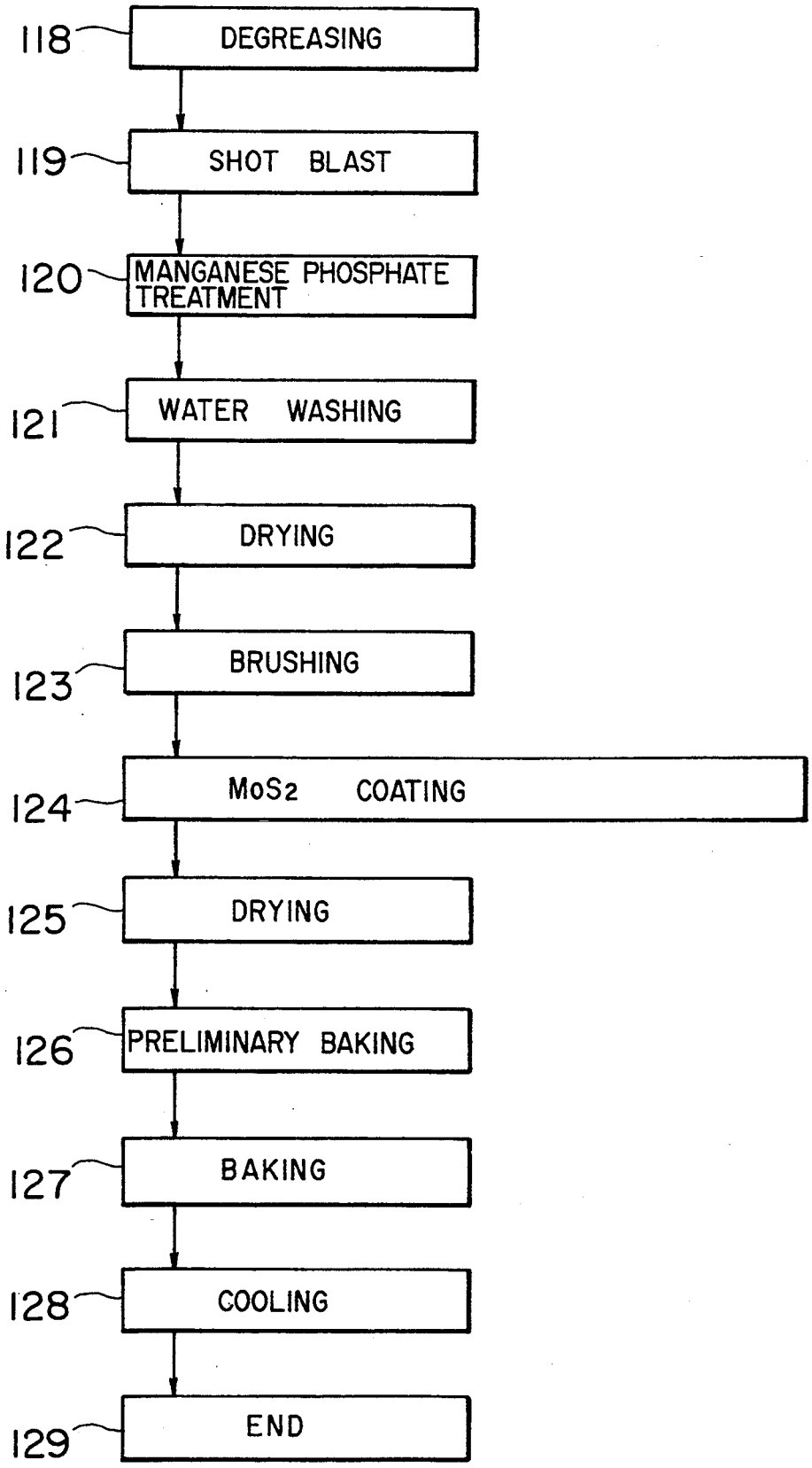
FIG. 19 PRIOR ART
FIG. 19 illustrates a process flow for performing conventional $MOS_2$ coating.
Figure 23:
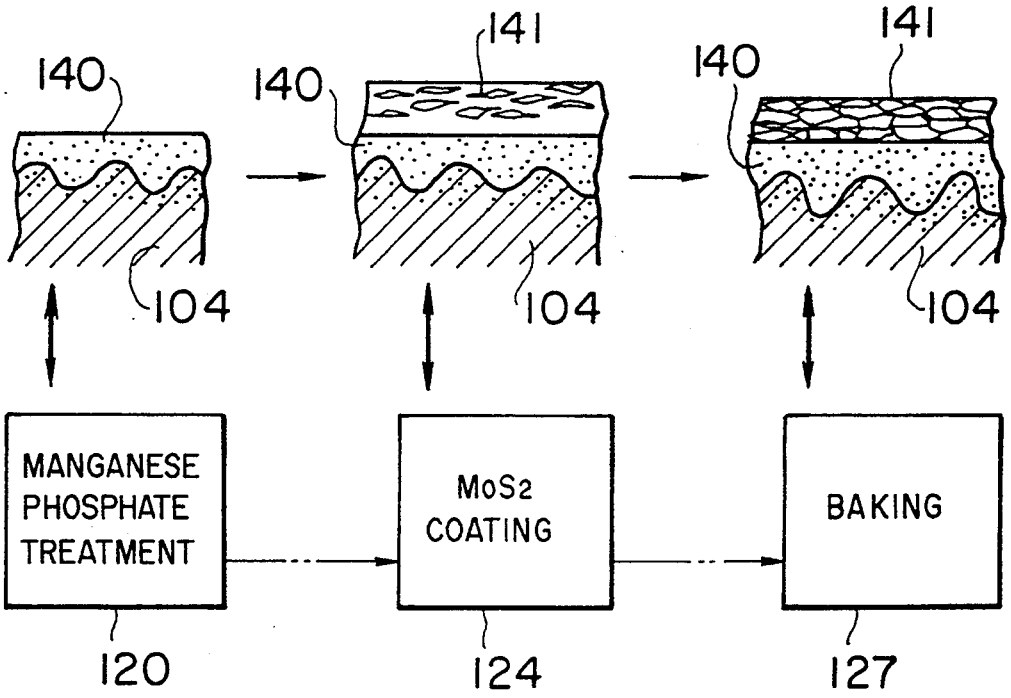
FIG. 23 PRIOR ART
FIG. 23 illustrates a process of formation of a conventional $MoS_2$ coating film.

FIGS. 19 and 23 illustrate the flow of the conventional $MOS_2$ coating process and the process of the formation of the $MoS_2$ coating film.

In the $MoS_2$ coating process, after the degreasing 118 and the shot blasting 119 are performed, manganese phosphate treatment 120, water-washing 121 and drying 122 are performed so that a manganese phosphate film 140 is formed on the rotor base 104. Then, brushing 123 is performed, and then $MoS_2$ coating 124 and drying 125 are performed so that a withered-leaf-like $MoS_2$ particles 141 are stacked. Then, preliminary baking 126 and baking 127 are performed, and the $MoS_2$ particles 141 are bonded together by a binder. The $MoS_2$ film has a structure that $MOS_2$ particles 141 are stacked and the spaces among them are filled with the binder. If the binder and the manganese phosphate film 140 is subjected to a hot temperature higher than 200° C., their corrosion resistance deteriorates. Therefore, pin holes are easily formed between the $MoS_2$ particles 141 and 141. Since the temperature of air in the compression chamber of the dry screw compressor is sometimes raised to a level higher than 200° C. due to adiabatic compression, there is fear that satisfactory corrosion resistance effect cannot be always mentioned by the $MOS_2$ coating.

On the other hand, PFA coating causes the surface of the rotor base 104 to be covered with a melted-and-solidified continuous and uniform PFA particles 131. Therefore, pin holes cannot easily be formed so that a satisfactory corrosion resistance can be obtained even if the thickness of the PFA coating film 106 is very thin (50 μm or thinner). Since the PFA particles 131 are melted and integrated in the PFA film 106, there is not a fear of deterioration of the coating film 106 due to drop of the granular powder.

Since the PFA has a non-adhesive characteristic, foreign matter, such as dust in air, invaded into a small gap between the male rotor 101 and the female rotor 102 or among rotors 101, 102 and the casing 151 of the compression chamber of each of the compressor bodies 1 and 2 can easily be discharged. Therefore, (there is little fear that) a problem of locking of the rotors 101 and 102 occurs.

By applying the PFA coating to the rotors 101 and 102 of the dry screw compressors 1 and 2 as described above, rust generation in the rotors 101 and 102 can be prevented and locking due to the rust in a small gap between rotors 101 and 102, or among the rotors 101 and 102 and the casing 151 can be avoided. Therefore, the locking of the rotors 101 and 102 due to rust can be avoided.

Figure 20:
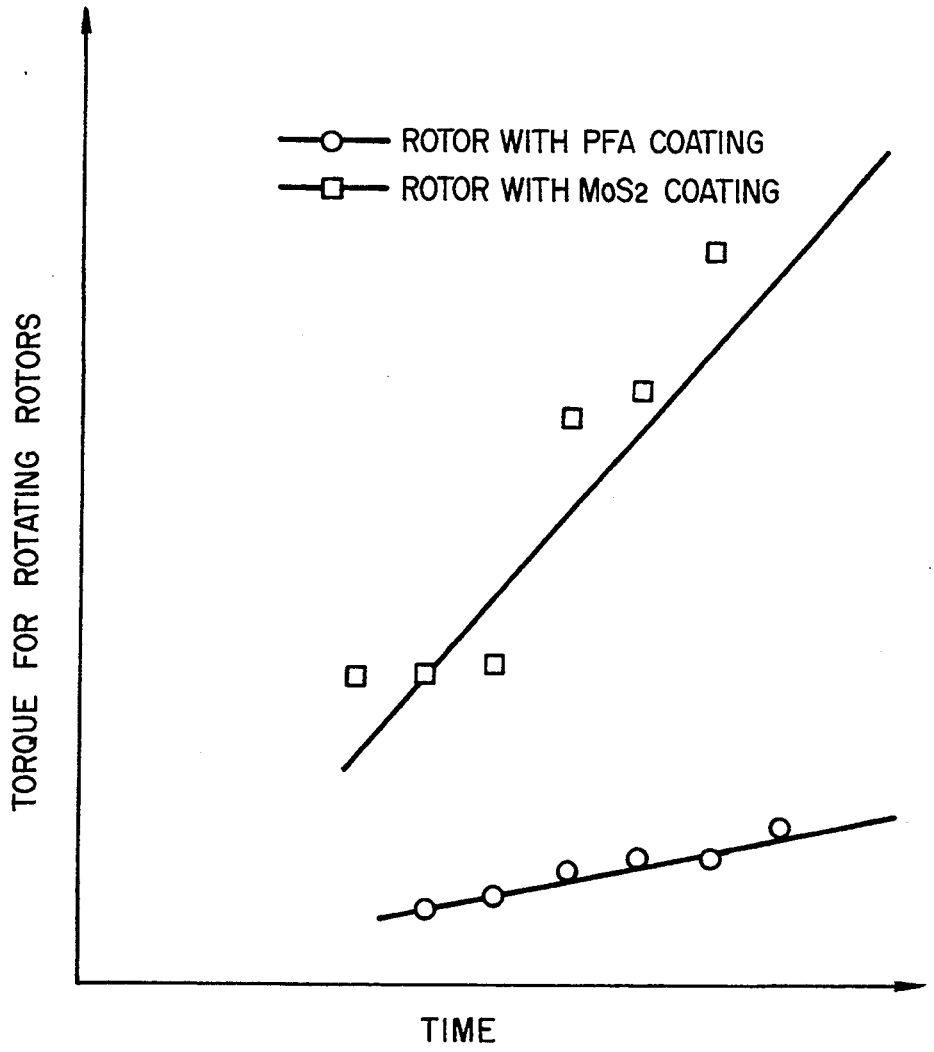
FIG. 20 is a graph which illustrates an effect of preventing locking of the rotor due to rust obtained in a screw compressor having screw rotor lobes applied with PFA coating in comparison with the effect obtained in the screw compressor havings screw rotor lobes applied with $MOS_2$ coating, where the locking was reproduced in a test for evaluating the locking.

FIG. 20 is a graph which illustrates the results of measurements of rotor-fixing or locking forces of rotors of the dry screw compressor comprising the rotors having lobes applied with the $MoS_2$ coating and of rotors of the dry screw compressor, the lobes of which were applied with the PFA coating (Teflon PFA (trade name) of Mitsui DuPont Florochemical), the measurements being evaluated by the rotational torque required to rotate the rotors after salt water was periodically sprayed followed by leaving to force to generate locking of the rotors due to rust. In comparison with the rotors with the conventional $MoS_2$ coating, a fact can be understood from FIG. 20 that the rotors with the PFA coating enables more satisfactory effect of preventing rust of the rotors. Therefore, there is less fear of locking of the rotors due to rust.

As described above, if the PFA coating is applied to the lobes of the screw rotors, generation of rust of the screw rotor lobes can be minimized. Even if rust is generated in the casing, the non-adhesive characteristic of the fluoro resin suppresses fixation of the rotor with the rust of the casing. As a result, locking of the rotors in the gas compression chamber due to rust can be prevented.

Although the invention has been described in its preferred form with a certain degree of particularly, it is understood that the present disclosure of the preferred form has been changed in the details of construction and the combination and arrangement of parts may be resorted to without departing from the spirit and the scope of the invention as hereinafter claimed.

We claim:

1. A dry screw compressor comprising:

a male rotor having spiral and projecting teeth;

a female rotor having spiral and concave teeth; and a casing in which said male rotor and said female rotor are so supported by a bearing disposed in said casing while being connected to each other through synchronizing gears, said male rotor and said female rotor being rotated in a non-contact manner while the teeth of said rotors being substantially engaged with each other, wherein each of said male rotor and said female rotor is covered with a melted-and-solidified substantially homogeneous and continuous layer consisting of tetrafluoroethylene-perfluoroalkylvinylether copolymer such that the layer is substantially devoid of pin holes.

2. In a dry screw compressor having plural rotors, the improvement comprising a melted-and-solidified substantially homogeneous and continuous layer consisting of tetrafluoroethylene-perfluoroalkylvinylether copolymer such that the layer is substantially devoid of pin holes.

3. The dry screw compressor according to claim 1, wherein the layer has a thickness of no greater than about 50 μm.

4. The dry screw compressor according to claim 1, wherein the rotors have spiral teeth.

5. The dry screw compressor according to claim 1, wherein the rotors comprise a female rotor with concave teeth and a male rotor with projecting teeth.

6. The dry screw compressor according to claim 5, wherein the layer has a thickness of no greater than about 50 μm.

7. The dry screw compressor according to claim 6, wherein the rotors have spiral teeth.

8. The dry screw compressor according to claim 1, wherein the rotors are operatively arranged to rotate in a non-contact manner.

9. The dry screw compressor according to claim 8, wherein the layer has a thickness of no greater than about 50 μm.

10. The dry screw compressor according to claim 9, wherein the rotors have spiral teeth.

11. The dry screw compressor according to claim 10, wherein the rotors comprise a female rotor with concave teeth and a male rotor with projecting teeth.

12. The dry screw compressor according to claim 5, wherein the teeth of the rotors are sized and arranged to be substantially operatively engaged with each other.

13. The dry screw compressor according to claim 12, wherein the layer has a thickness of no greater than about 50 μm.

14. The dry screw compressor according to claim 13, wherein the rotors have spiral teeth.

15. The dry screw compressor according to claim 1, wherein the compressor further comprises a casing with a bearing arrangement for operatively supporting the rotors, and synchronizing gearing for operatively connecting the rotors with each other.

16. The dry screw compressor according to claim 15, Wherein the layer has a thickness of no greater than about 50 μm.

17. The dry screw compressor according to claim 16, wherein the rotors have spiral teeth.

18. The dry screw compressor according to claim 17, wherein the rotors comprise a female rotor with concave teeth and a male rotor with projecting teeth.

19. The dry screw compressor according to claim 18, wherein the rotors are operatively arranged to rotate in a non-contact manner.

20. The dry screw compressor according to claim 19, wherein the teeth of the rotors are sized and arranged to be substantially operatively engaged with each other.

21. The dry screw compressor according to claim 1, wherein the layer is baked-on so as to constitute a non-adhesive continuous layer.

22. A rotor having an outer melted-and-solidified substantially homogeneous and continuous layer consisting of tetrafluoroethylene-perfluoroalkylvinylether copolymer such that the layer is substantially devoid of pin holes.

23. The rotor according to claim 22, wherein the layer has a thickness of no greater than about 50 μm.

24. The rotor according to claim 22, wherein the rotor has spiral teeth.

25. The rotor according to claim 22, wherein the rotor is a female rotor with concave teeth.

26. The rotor according to claim 22, wherein the rotor is a male rotor with projecting teeth.

27. The rotor according to claim 22, wherein the layer is a baked-on, non-adhesive continuous layer.

28. The rotor according to claim 27, wherein the layer has a thickness of no greater than about 50 μm.

29. A dry screw compressor rotor produced by a process of (a) primer coating a desired surface area of a predetermined shape of the rotor, (b) applying a coating consisting of tetrafluoroethylene-perfluoroalkylvinylether on the area, (c) heating to bake on the coating of tetrafluoroethylene-perfluoroalkylvinylether, and (d) repeating, if necessary, steps (b) and (c) until a predetermined thickness of the tetrafluoroethylene-perfluoroalkylvinylether coating has been applied as a substantially homogeneous and continuous layer devoid of pin holes over the rotor.

30. A dry screw compressor having male and female rotors, wherein the rotors are produced by a process of (a) primer coating a desired surface area of a predetermined shape of the rotor, (b) applying a coating consisting of tetrafluoroethylene-perfluoroalkylvinylether on the area, (c) heating to bake on the coating of tetrafluoroethylene-perfluoroalkylvinylether, and (d) repeating, if necessary, steps (b) and (c) until a predetermined thickness of the tetrafluoroethylene-perfluoroalkylvinylether coating has been applied as a substantially homogeneous and continuous layer devoid of pin holes over the rotor.

* * * * *